US007513600B2

(12) United States Patent
Yamanobe

(10) Patent No.: US 7,513,600 B2
(45) Date of Patent: Apr. 7, 2009

(54) LIQUID DROPLET DISCHARGE HEAD AND IMAGE FORMING APPARATUS

(75) Inventor: Jun Yamanobe, Ashigara-Kami-Gun (JP)

(73) Assignee: Fujifilm Corporation, Tokyo (JP)

( * ) Notice: Subject to any disclaimer, the term of this patent is extended or adjusted under 35 U.S.C. 154(b) by 411 days.

(21) Appl. No.: 11/087,746

(22) Filed: Mar. 24, 2005

(65) Prior Publication Data

US 2005/0212872 A1 Sep. 29, 2005

(30) Foreign Application Priority Data

Mar. 26, 2004 (JP) ..... 2004-093476

(51) Int. Cl.
*B41J 2/21* (2006.01)

(52) U.S. Cl. ..... 347/43; 347/40

(58) Field of Classification Search ..... 347/40–43
See application file for complete search history.

(56) References Cited

U.S. PATENT DOCUMENTS

| | | | | |
|---|---|---|---|---|
| 5,923,348 | A * | 7/1999 | Cunnagin et al. | 347/42 |
| 6,217,148 | B1 * | 4/2001 | Adler et al. | 347/41 |
| 6,328,418 | B1 * | 12/2001 | Yamada et al. | 347/40 |
| 6,350,011 | B1 * | 2/2002 | Karlinski | 347/40 |
| 6,530,647 | B2 * | 3/2003 | Kubota et al. | 347/43 |
| 6,533,371 | B2 | 3/2003 | Hori et al. | |
| 7,090,331 | B2 * | 8/2006 | Karasawa et al. | 347/41 |

FOREIGN PATENT DOCUMENTS

| | | | |
|---|---|---|---|
| JP | 2-78558 | A | 3/1990 |
| JP | 6-183033 | A | 7/1994 |
| JP | 9-507803 | A | 8/1997 |
| JP | 11-240158 | A | 9/1999 |
| JP | 2002-273878 | A | 9/2002 |
| WO | WO-96/14987 | A1 | 5/1996 |

* cited by examiner

*Primary Examiner*—Thinh H Nguyen
(74) *Attorney, Agent, or Firm*—Birch, Stewart, Kolasch & Birch, LLP

(57) ABSTRACT

The liquid droplet discharge head comprises: a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, in such a manner that: at least a portion of dots formed by the droplets deposited on the recording medium from the nozzles overlap mutually in the main scanning direction; and with respect to a first nozzle and a second nozzle which discharge droplets to form mutually adjacent dots in the main scanning direction on the recording medium, and with respect to a third nozzle which is adjacent to the first nozzle in the sub-scanning direction, positions of the first nozzle and the second nozzle are separated in the sub-scanning direction by at least a distance equal to a multiple by an integer that is at least two, of a distance between the first nozzle and the third nozzle in the sub-scanning direction, and positions of the first nozzle and the third nozzle are separated in the main scanning direction by at least a distance equal to a maximum dot diameter formed by the liquid droplets discharged onto the recording medium from the first nozzle and the third nozzle.

14 Claims, 15 Drawing Sheets

LIQUID DROPLET DISCHARGE HEAD AND IMAGE FORMING APPARATUS

BACKGROUND OF THE INVENTION

1. Field of the Invention

The present invention relates to a liquid droplet discharge head and an image forming apparatus, and more specifically, to a liquid droplet discharge head and an image forming apparatus in which nozzles which discharge liquid droplets are arranged in a two-dimensional matrix array.

2. Description of the Related Art

Inkjet recording apparatuses (inkjet printers) having an inkjet head (ink ejection head) in which a plurality of nozzles are arranged, are known as image forming apparatuses. An inkjet recording apparatus of this kind forms images by forming dots on a recording medium, by ejecting ink as droplets from nozzles, while causing the inkjet head and the recording medium to move relatively to each other.

Various methods are known conventionally as ink discharge methods for an inkjet recording apparatus of this kind. For example, one known method is a piezoelectric method, where the volume of a pressure chamber (ink chamber) is changed by causing a diaphragm forming a portion of the pressure chamber to deform due to deformation of a piezoelectric element (piezoelectric actuator), ink being introduced into the pressure chamber from an ink supply passage when the volume is increased, and the ink inside the pressure chamber being ejected as a droplet from the nozzle when the volume of the pressure chamber is reduced. Another known method is a thermal inkjet method where ink is heated to generate a bubble in the ink, and ink is then ejected by means of the expansive energy created as the bubble grows.

In an inkjet recording apparatus, one image is represented by combining dots formed by ink ejected from the nozzles. High image quality can be achieved by making the dots small in size, increasing the density of the dots and by using a large number of pixels per image.

FIG. 19, for example, shows an enlarged view of a portion of an inkjet head in which nozzles are arranged in a two-dimensional matrix array. The inkjet head 90 shown in FIG. 19 records images by discharging ink from the nozzles 91 (91*a*, 91*b*, 91*c*), onto a recording medium (not illustrated) which is conveyed relatively to the inkjet head 90. The inkjet head 90 is disposed in such a manner that the lengthwise direction of the head is aligned with the breadthways direction of the recording medium (a main scanning direction), which is perpendicular to the direction of conveyance of the recording medium (the sub-scanning direction).

Pressure chambers 92 correspond respectively to each nozzle 91 of the inkjet head 90. As shown in FIG. 19, the nozzles 91 are disposed respectively in the main scanning direction and the sub-scanning direction, thereby forming a two-dimensional matrix arrangement. In this case, the direction in which the nozzles 91 are arranged in the sub-scanning direction does not coincide totally with the sub-scanning direction (the direction perpendicular to the main scanning direction), but rather, they are arranged at a slightly oblique angle with respect to the sub-scanning direction. For example, the distance, Pm, in the main scanning direction between nozzles which are mutually adjacent in the sub-scanning direction, such as nozzle 91*a* and nozzle 91*b* is clearly smaller than the distance L1 between the nozzle 91*a* and the nozzle 91*c* adjacent to same in the main scanning direction (this distance being equal to the approximate size of a pressure chamber 92).

By arranging the nozzles 91 at a slight oblique angle with respect to the sub-scanning direction in this way, after a dot 93*a* has been formed by discharging ink onto the recording medium from the nozzle 91*a*, for example, the recording medium is conveyed through a distance corresponding to the size L2 of a pressure chamber 92, in the sub-scanning direction, and if ink is then discharged onto the recording medium from nozzle 91*b*, it will form a dot 93*b* that is directly alongside the dot 93*a* formed previously by nozzle 91*a*, in the main scanning direction. The distance between the centers of these dots (the center-to-center distance) is equal to the distance, Pm, in the main scanning direction between the nozzles (91*a* and 91*b*) which are mutually adjacent in the sub-scanning direction as described above. In this way, by arranging nozzles 91 in a matrix fashion, and positioning this matrix at a slight oblique angle, it is possible to achieve high density of the nozzles (which means a high density of the dots formed by these nozzles).

For example, Japanese Patent Application Publication No. 9-507803 describes an inkjet head in which nozzles are arranged in a two-dimensional matrix array comprising n rows and m columns, in such a manner that the connections to the respective individual electrodes are reduced and high density is achieved.

Furthermore, a line type inkjet head is known in which respective head chips having a plurality of ink nozzles arranged in a single row are arrayed on the same substrate in a staggered two-row fashion, at an oblique angle with respect to the direction of arrangement (see Japanese Patent Application Publication No. 2002-273878, for example).

However, in high-speed inkjet head printing using a line head in which the nozzles are arranged at high density, since the droplet ejection intervals between respective liquid droplets is very short, a phenomenon known as "landing interference" or "droplet ejection interference" may occur, in which the liquid droplets discharged onto the recording medium make contact and overlap with each other before becoming fixed in the recording medium, the droplets combining to form one big droplet, or the shapes of the dots becoming disrupted as they permeate into the recording medium, thus leading to bleeding, color mixing, and the like. This causes image quality to decline. The coalescence of the liquid droplets occurs not only in the sub-scanning direction, which is the conveyance direction of the recording medium, but also in the main scanning direction perpendicular to the sub-scanning direction. If coalescence of liquid droplets occurs in two dimensions in this way, then particularly significant image degradation occurs.

Moreover, in a conventional inkjet head as illustrated in FIG. 19, since the nozzles are simply arranged at an oblique angle to the sub-scanning direction, then after respective ink droplets which are mutually adjacent in the main scanning direction have landed on the recording medium, the droplets coalesce before becoming fixed and hence form a large droplet. This leads to image degradation.

Moreover, in the device disclosed in Japanese Patent Application Publication No. 9-507803, the nozzles are simply arrayed in a two-dimensional matrix arrangement, and there is no particular disclosure regarding the method of arranging the nozzles. Therefore, it involves problems similar to those of conventional inkjet heads as described above.

Moreover, the device disclosed in Japanese Patent Application Publication No. 2002-273878 has the objective of achieving high density in a line type head, and it does not disclose the relationship between the dot diameter and nozzle arrangement, in order to prevent landing interference. Therefore, if printing is carried out using a line head having the nozzle arrangement described in Japanese Patent Application Publication No. 2002-273878, then similarly to a conventional simple matrix head as illustrated in FIG. 19, there is a risk that dots which are discharged by adjacent nozzles in the main scanning direction will coalesce and aggregate before becoming fixed on the recording medium, and hence degradation of image quality will occur.

SUMMARY OF THE INVENTION

The present invention has been contrived with the foregoing circumstances in view, and an object thereof is to provide a liquid droplet discharge head and an image forming apparatus whereby landing interference is prevented in such a manner that there is no coalescence or bleeding of liquid droplets discharged from different nozzles so as to overlap mutually on the recording medium.

In order to attain the aforementioned object, the present invention is directed to a liquid droplet discharge head, comprising: a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, in such a manner that: at least a portion of dots formed by the droplets deposited on the recording medium from the nozzles overlap mutually in the main scanning direction; and with respect to a first nozzle and a second nozzle which discharge droplets to form mutually adjacent dots in the main scanning direction on the recording medium, and with respect to a third nozzle which is adjacent to the first nozzle in the sub-scanning direction, positions of the first nozzle and the second nozzle are separated in the sub-scanning direction by at least a distance equal to a multiple by an integer that is at least two, of a distance between the first nozzle and the third nozzle in the sub-scanning direction, and positions of the first nozzle and the third nozzle are separated in the main scanning direction by at least a distance equal to a maximum dot diameter formed by the liquid droplets discharged onto the recording medium from the first nozzle and the third nozzle.

Preferably, the distance between the first nozzle and the third nozzle in the main scanning direction is at least a distance equal to a multiple by an integer that is at least two, of a distance between the first nozzle and the second nozzle in the main scanning direction.

By arranging nozzles in this way, it is possible reliably to prevent landing interference between liquid droplets that are mutually adjacent in the main scanning direction.

In order to attain the aforementioned object, the present invention is also directed to a liquid droplet discharge head, comprising: a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, in such a manner that: at least a portion of dots formed by the droplets deposited on the recording medium from the nozzles overlap mutually in the main scanning direction; and a plurality of nozzle blocks are formed by a plurality of nozzle rows aligned along the main scanning direction, the nozzle rows being arranged adjacently in the sub-scanning direction and being displaced with respect to each other in the main scanning direction, in such a manner that there always exists one nozzle row displaced by a prescribed distance in the main scanning direction with respect to any other nozzle row; and when a minimum distance between the nozzles in the main scanning direction in the liquid droplet discharge head is denoted by Pm, the nozzle blocks that are adjacent in the sub-scanning direction are displaced by a prescribed interval in the sub-scanning direction and are also displaced in the main scanning direction by the minimum distance between the nozzles, Pm, in the main scanning direction.

Preferably, the prescribed distance by which the nozzle rows are displaced in the main scanning direction is set to be equal to $N \times Pm$, where Pm is the minimum distance between the nozzles in the main scanning direction, and N is a number of nozzle blocks.

Preferably, the prescribed interval between the nozzle blocks in the sub-scanning direction is set to be equal to $M \times Ps$, where Ps is a minimum distance between the nozzles in the sub-scanning direction which is a distance between the nozzles that are mutually adjacent in the sub-scanning direction in the nozzle array, and M is a number of the nozzle rows constituting the nozzle block.

By this means, it is possible to simplify nozzle drive control, since the nozzle array pitch is uniform in the sub-scanning direction.

Preferably, the prescribed interval in the sub-scanning direction between a first nozzle block and a second nozzle block, respectively having first nozzles and second nozzles that discharge droplets to form dots overlapping in the main scanning direction on the recording medium, is set to be at least a distance through which the recording medium is conveyed relatively in a time period from a landing time of a first dot discharged from a first nozzle until a time at which the first dot proceeds to become fixed in the recording medium and a diameter of the liquid droplet of the first dot on the recording medium reduces to such a size that the droplet does not make contact with a droplet on a surface of the recording medium corresponding to a second dot discharged from a second nozzle after landing of the first dot.

By this means, it is possible to prevent landing interference between droplets ejected to form dots that are mutually adjacent or overlapping in the main scanning direction. Therefore, high dot density can be achieved and high-quality image recording becomes possible.

Preferably, when a maximum dot diameter of a liquid droplet deposited onto the recording medium by any nozzle constituting the nozzle row is denoted by Dmax, a number of the plurality of nozzle blocks N is set to satisfy $Dmax \leqq N \times Pm$, where Pm is the minimum distance between the nozzles in the main scanning direction. By this means, it is possible to prevent landing interference between dots ejected with a short time difference from nozzles disposed adjacently in the sub-scanning direction.

In order to attain the aforementioned object, the present invention is also directed to a liquid droplet discharge head, comprising: a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, in such a manner that: at least a portion of dots formed by the droplets deposited on the recording medium from the nozzles overlap mutually in the main scanning direction; a distance in the sub-scanning direction between a first nozzle and a second nozzle which discharge droplets to form a first dot and a second dot so as to be mutually adjacent or overlapping in the main scanning direction on the recording medium, is set to be at least a distance through which the recording medium is conveyed in a time period from a landing time of the first dot on the recording medium, until a time at which the droplet of the first dot has been fixed in the recording medium and a diameter of the droplet on a surface of the recording medium has reduced to such a size that the droplet does not make contact with a liquid droplet on the surface of the recording medium corresponding to a second dot deposited after the first dot has landed; and the first nozzle and a third nozzle adjacent to the first nozzle in the sub-scanning direction are positioned in such a manner that a distance in the main scanning direction between the first nozzle and the third nozzle is at least a maximum dot diameter formed by the liquid droplets discharged onto the recording medium from the first nozzle and the third nozzle.

By this means, it is possible to prevent landing interference between adjacent dots, in an effective manner.

In order to attain the aforementioned object, the present invention is also directed to an image forming apparatus, comprising the above-described liquid droplet discharge head.

By this means, landing interference between adjacent dots is prevented, and hence high-quality image recording can be achieved.

As described above, according to the liquid droplet discharge head and the image forming apparatus according to the present invention, the distance in the sub-scanning direction between nozzles which are adjacent in the main scanning direction is set to a prescribed distance of separation, and hence the time interval between the landing times of droplets discharged from different nozzles so as to overlap mutually on the recording medium is increased, thereby preventing landing interference and eliminating bleeding.

Furthermore, if the distance in the main scanning direction between nozzles that are mutually adjacent in the sub-scanning direction is set to be greater than the diameter of the droplets discharged from the nozzles, then droplets discharged from nozzles that are adjacent in the sub-scanning direction are prevented from coalescing, and hence image degradation is avoided.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, a liquid droplet discharge head and an image forming apparatus according to the present invention are described in detail, with reference to the accompanying drawings.

In the liquid droplet discharge head according to the present invention, when arranging the nozzles in a two-dimensional matrix array, the nozzles are displaced with respect to each other as described in detail below, rather than simply arranging the nozzles in an oblique fashion as in the related art. Therefore, the time interval between the ejection of droplets which are discharged from different nozzles and overlap mutually on the recording medium is increased, thereby preventing landing interference between adjacent dots.

Figure 1:
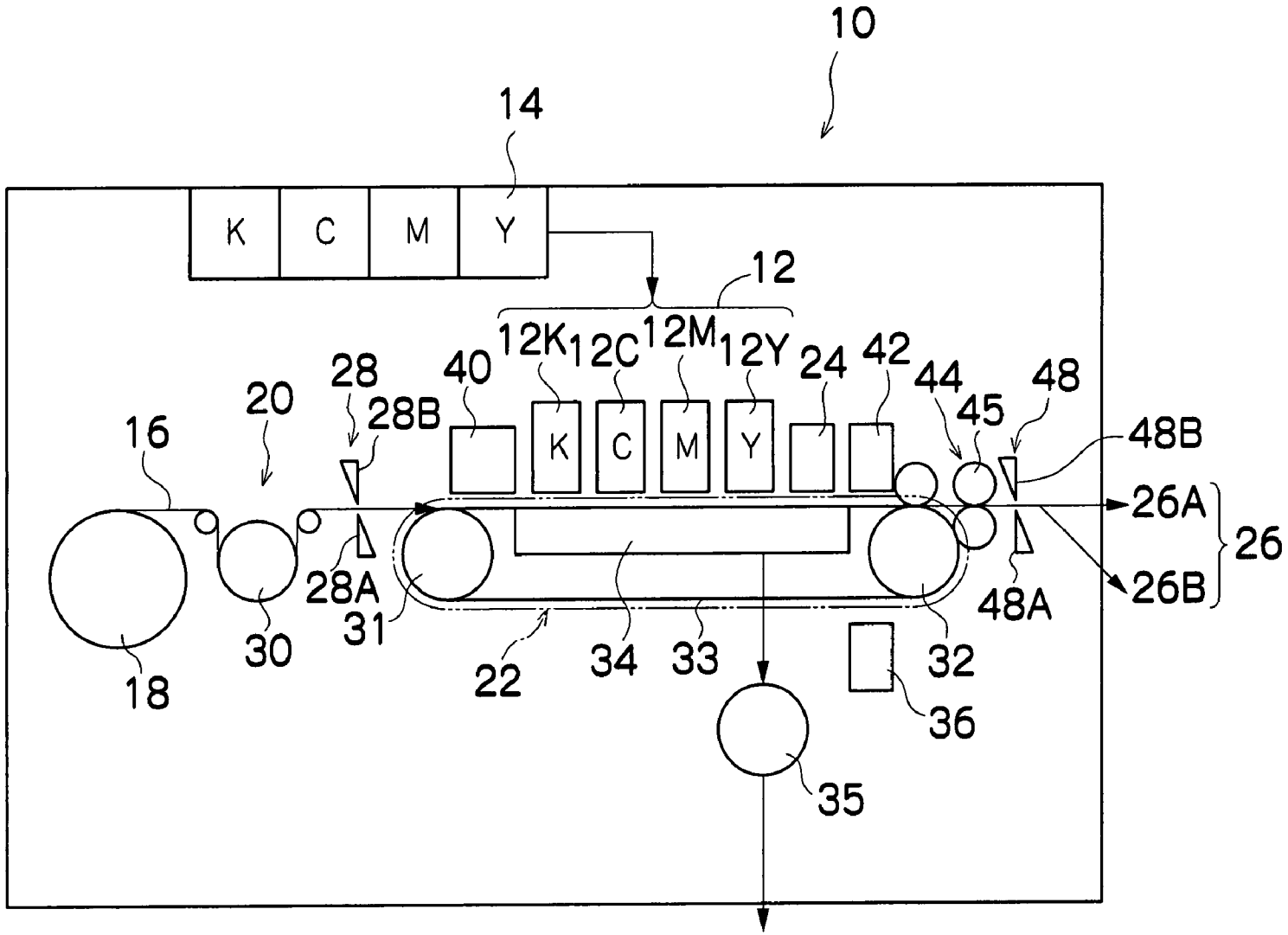
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of droplet discharge heads or print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
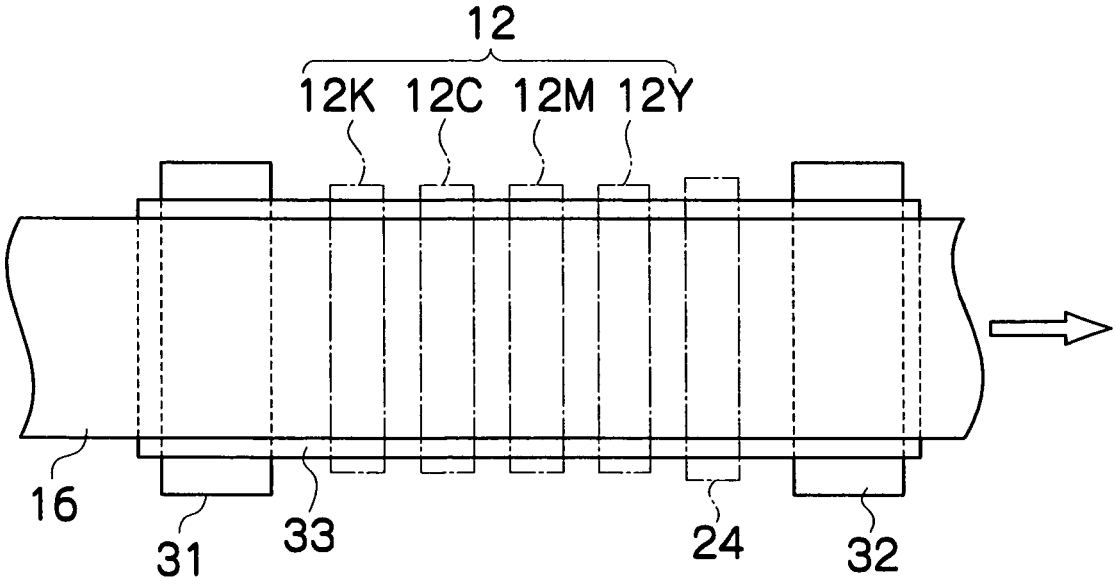
FIG. 2 is a principal plan view of the peripheral area of a print unit in the inkjet recording apparatus illustrated in FIG. 1.
Figure 3:
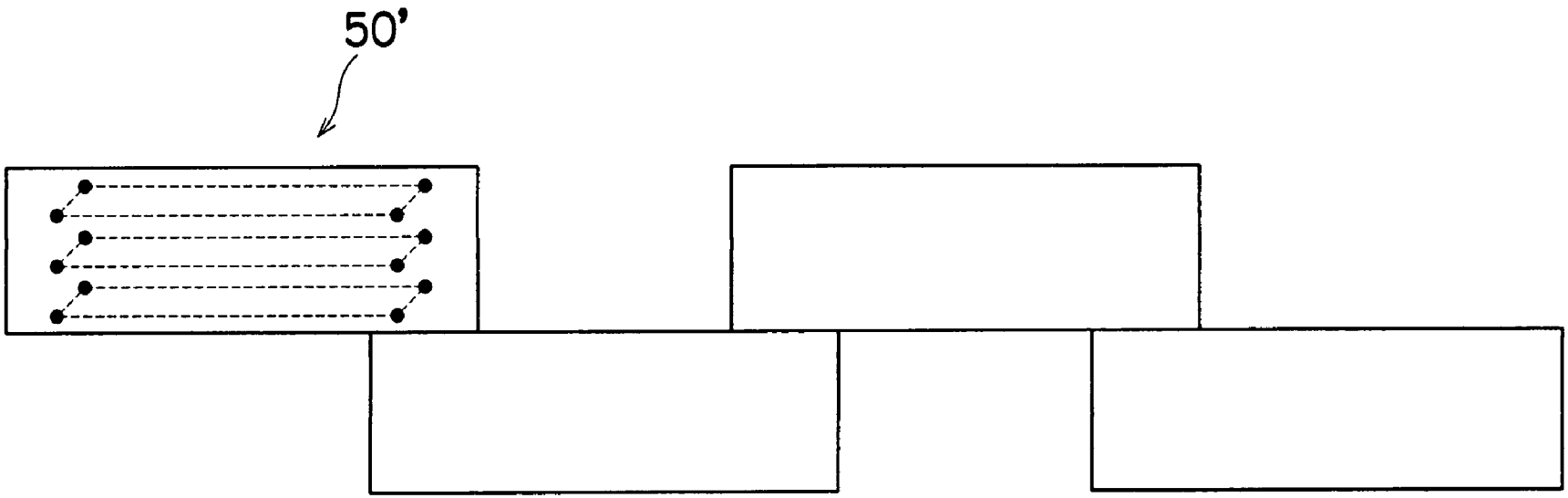
FIG. 3 is a plan view perspective diagram showing a further example of the structure of a print head.

The printing unit 12 includes the print heads 12K, 12C, 12M, and 12Y corresponding to four ink colors (KCMY), and forms a so-called full-line head in which each of the print heads 12K, 12C, 12M, and 12Y is disposed in the paper width direction (main scanning) perpendicular to the paper conveyance direction (sub-scanning) among a length that corresponds to the maximum paper width, as referred in FIG. 2.

As shown in FIG. 2, each of the print heads 12K, 12C, 12M, and 12Y is composed of a line head in which a plurality of ink-droplet ejection apertures (nozzles) are arranged along a length that exceeds at least one side of the maximum-size recording paper 16 intended for use in the inkjet recording apparatus 10.

Although the structure is not described in detail, each of the print heads 12K, 12C, 12M, and 12Y is provided with various devices for determining the ink discharge condition, the discharged ink-droplet size, the ink-ejecting speed, or the like (for example, a determination device for determining the ink discharge, a optical system for forming a luminous flux for determination in a desired shape, and the like).

The print heads 12K, 12C, 12M, and 12Y are arranged in this order from the upstream side (the left-hand side in the diagram) along the delivering direction of the recording paper 16 (hereinafter referred to as the paper conveyance direction). A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Figure 4:
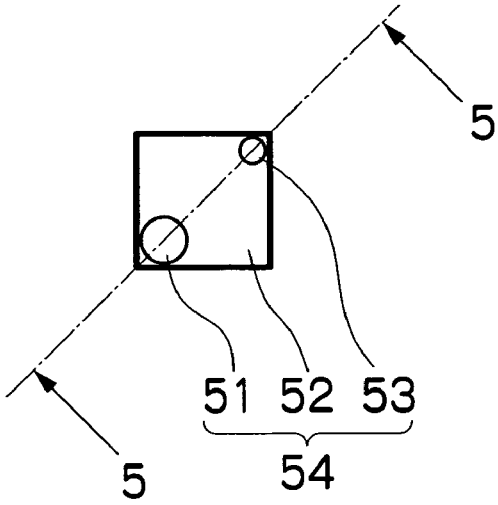
FIG. 4 is an enlarged view of a pressure chamber unit constituting a print head.

As shown in FIG. 2, the print heads 12K, 12C, 12M, and 12Y in the present embodiment are explained as a full-line head in which the ink-droplet ejection apertures (nozzles) are arranged in the form of a two-dimensionally matrix. Alternatively, as shown in FIG. 4, a full-line head may be composed of a plurality of short two-dimensionally arrayed heads 50' arranged in the form of a staggered and combined so as to form nozzle rows having lengths that correspond to the entire width of the recording medium. In this case, the short arrayed heads 50' are applied as the nozzle arrangement of the present embodiment.

Next, the structure of the droplet discharge heads or the print heads is described. The print heads 12K, 12C, 12M, and 12Y provided for the respective ink colors have the same structure, and a reference numeral 50 is hereinafter designated to any of the print heads 12K, 12C, 12M, and 12Y.

FIG. 4 is a perspective plan view showing a pressure chamber unit 54 structured in the print head 50. As shown in FIG. 4, the pressure chamber unit 54 comprises: nozzles 51 for ejecting ink-droplets; and pressure chambers 52 including supply ports 53. The planar shape of the pressure chamber 52 provided for each nozzle 51 is substantially a square, and the nozzle 51 and supply port 53 are disposed in both corners on a diagonal line of the square. Each pressure chamber 52 is connected to a common channel 55 (not shown in FIG. 4) through a supply port 53.

Figure 5:
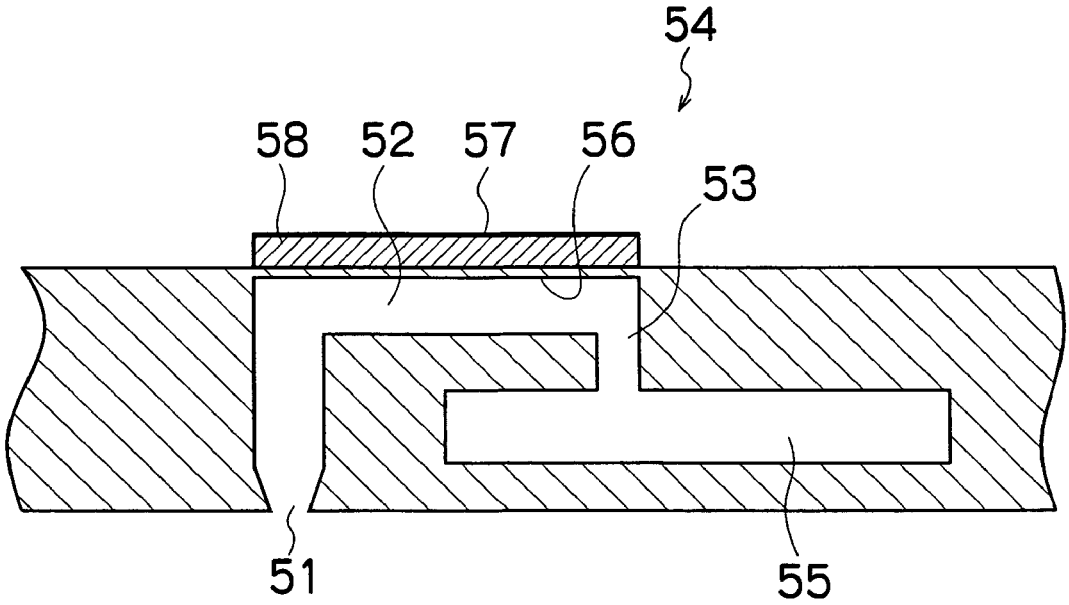
FIG. 5 is a cross-sectional diagram along line 5-5 in FIG. 4.

FIG. 5 is a cross-sectional view taken along the line 5-5 in FIG. 4, showing the inner structure of an ink chamber unit 54. As shown in FIG. 5, an actuator 58 having a discrete electrode 57 is joined to a pressure plate 56 which forms the ceiling of the pressure chamber 52. The actuator 58 is deformed by applying drive voltage to the discrete electrode 57 to eject ink from the nozzle 51 connected to the pressure chamber 52.

The pressure chamber 52 is connected to a common channel 55 through a supply port 53. When ink is ejected, new ink is delivered from the common flow channel 55 through the supply port 53 to the pressure chamber 52.

In addition, as the method for controlling to move the nozzles, here is described about "main scanning" and "sub-scanning". The "main scanning" and "sub-scanning" are methods for moving nozzle of the print head, and are defined as following.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Figure 6:
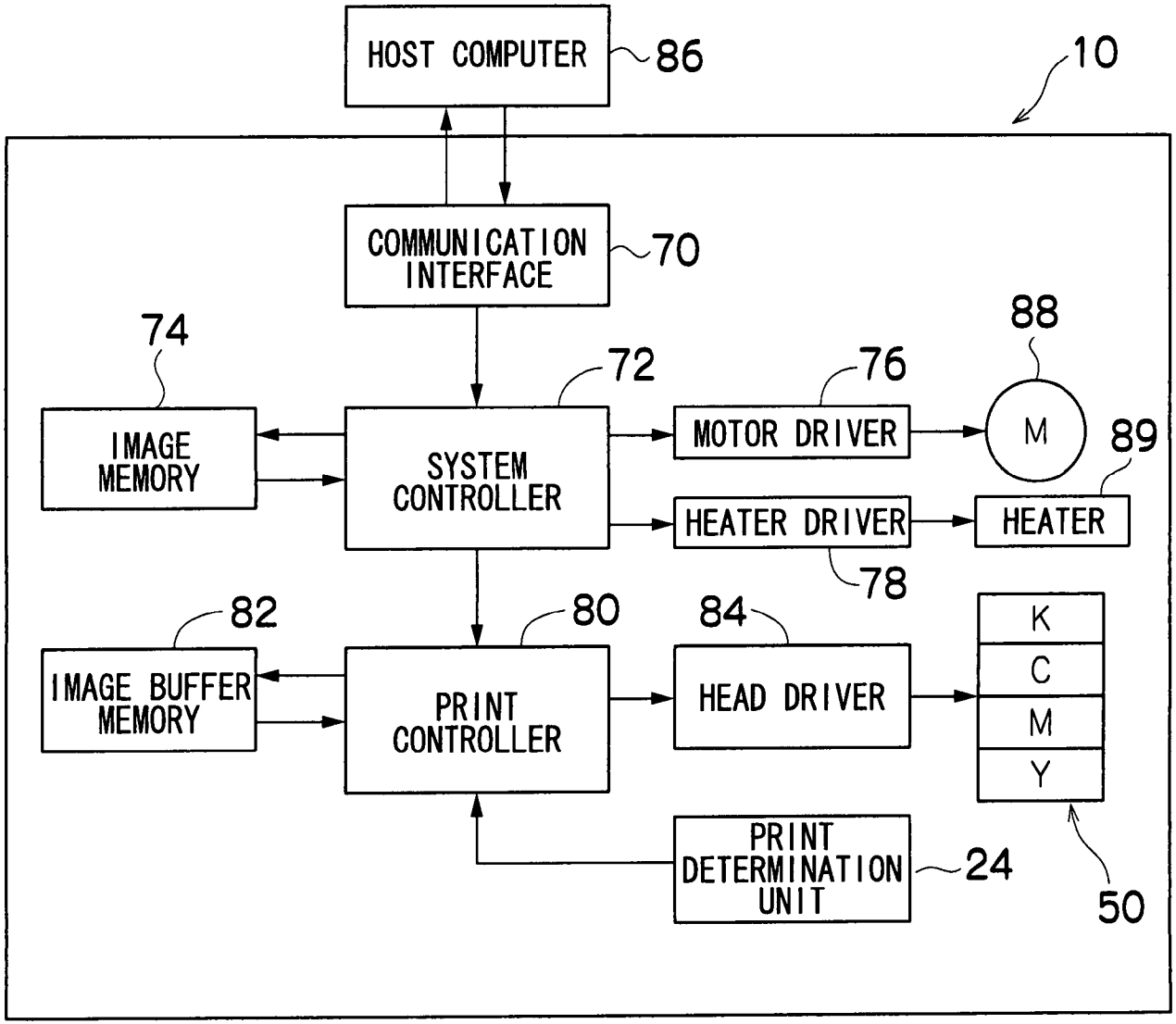
FIG. 6 is a diagram of the system composition of the inkjet recording apparatus illustrated in FIG. 1.

FIG. 6 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefore, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

Figure 7:
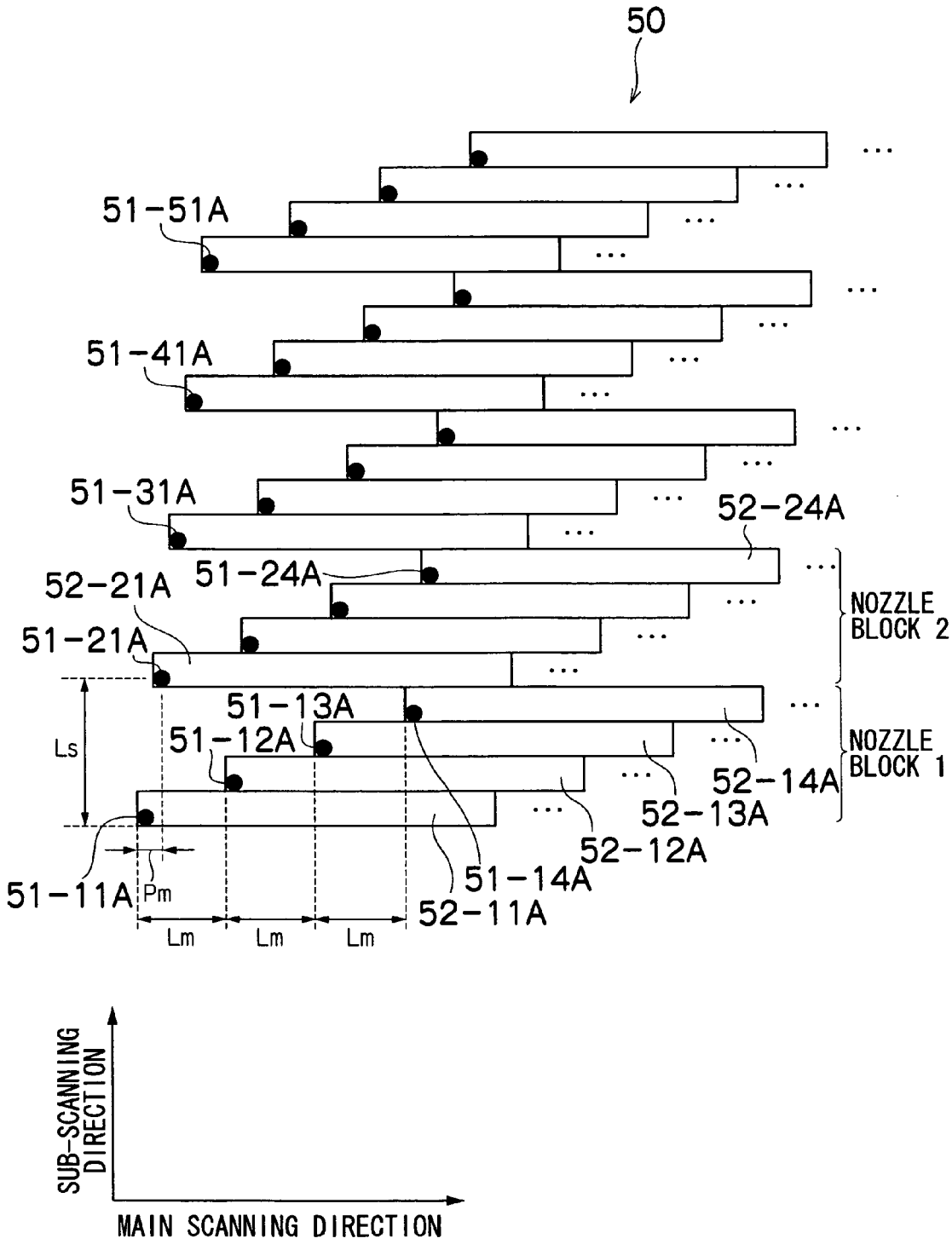
FIG. 7 is a principal plan diagram showing a nozzle arrangement in a print head according to the present embodiment.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

Next, the nozzle arrangement in the print head 50, which is the key feature of the present invention, will be described.

FIG. 7 shows an enlarged view of a portion of a nozzle arrangement in a print head 50 according to the present embodiment. As described previously, the print head 50 according to the present embodiment is formed in such a manner that the lengthwise direction of the head is disposed in line with the breadthways direction of the recording paper 16, and the recording paper 16 is conveyed in a direction perpendicular to the lengthwise direction of the print head 50 (namely, the breadthways direction of the head). Therefore, the lengthwise direction of the print head 50 is the main scanning direction and the breadthways direction thereof is the sub-scanning direction. The print head 50 achieves a two-dimensional matrix arrangement of the nozzles 51 by arraying pressure chambers 52, each having a nozzle 51, in a two-dimensional matrix arrangement in the main scanning direction and the sub-scanning direction, by means of the method described below. In FIG. 7, only twenty pressure chambers 52 are arranged in the sub-scanning direction for the purposes of illustration, but in an actual print head 50, a much larger number of pressure chambers 52 are arranged in a repeated fashion in the main scanning direction.

Furthermore, as shown in FIG. 4, the pressure chambers 52 are approximately square in shape, but in FIG. 7, the dimension of each pressure chamber 52 in the sub-scanning direction is depicted at a reduced scale of 1/20, with respect to the main scanning direction. The lower left-hand portion of FIG. 7 is shown as an enlargement in FIG. 8, where both the vertical and horizontal dimensions of the pressure chambers 52 are depicted according to a standard scale.

FIG. 7 shows only the pressure chambers 52 on the left-hand side in the main scanning direction. In the example shown in FIG. 7, the print head 50 has 20 pressure chambers 52 (52-11A, 52-12A, . . . 52-21A, . . . and so on) aligned in the sub-scanning direction, and each pressure chamber 52 has a nozzle 51 (51-11A, 51-12A, . . . and so on) disposed respectively at a standard position in the lower left corner.

Figure 8:
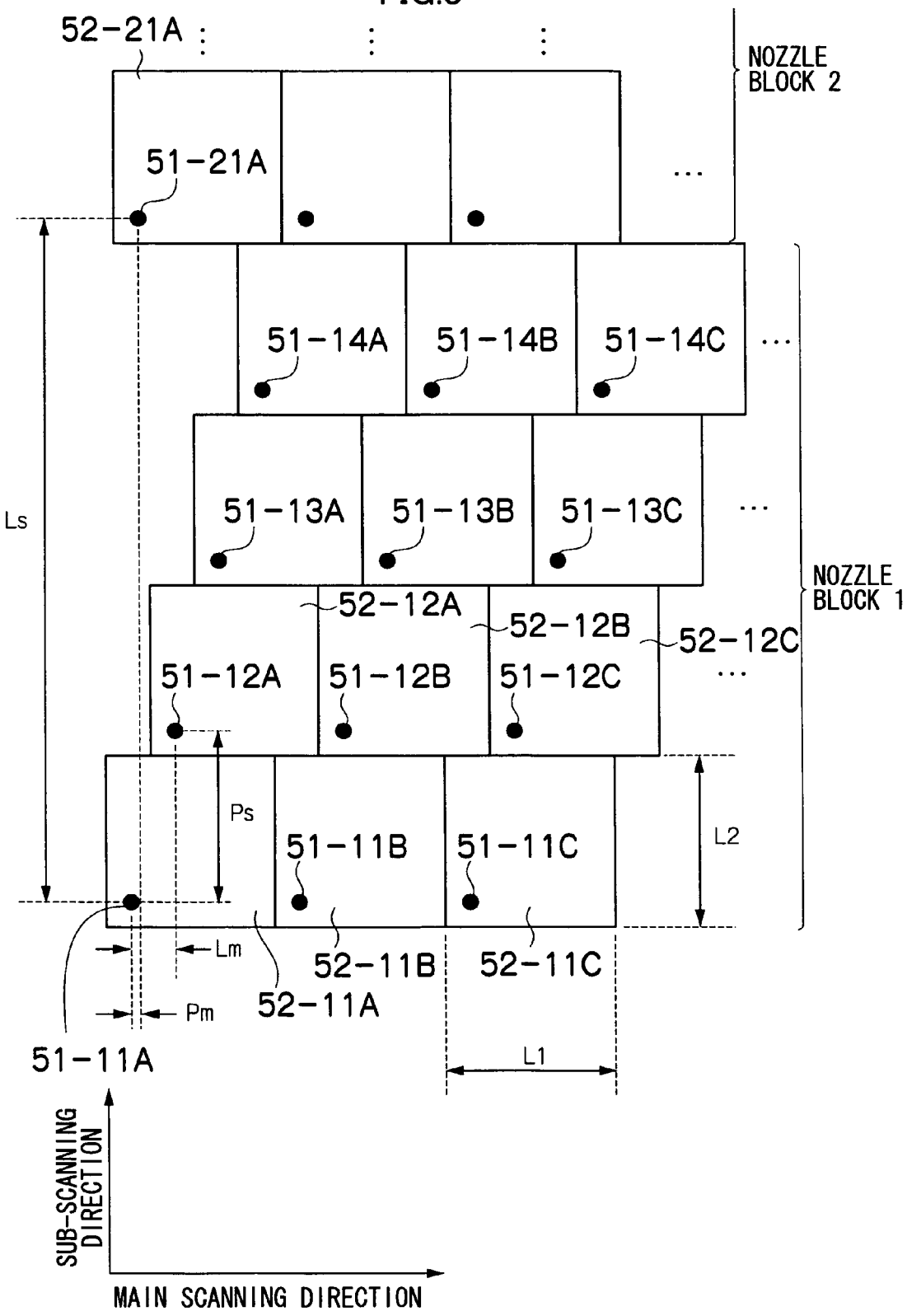
FIG. 8 is a plan view showing a partial enlarged view of a nozzle arrangement according to FIG. 7.

Therefore, the print head 50 has 20 nozzles 51 (51-11A, 51-12A, . . . , 51-12A, . . . , and so on) arranged in the sub-scanning direction. Furthermore, as shown in FIG. 8, the plurality of pressure chambers 52 and nozzles 51 are arranged in the main scanning direction. For example, in FIG. 8, in the lowest row in the main scanning direction, pressure chambers 52 are arranged from the left-hand side, as pressure chambers 52-11A, 52-11B, 52-11C, . . . , and in the row above this in the main scanning direction, the pressure chambers 52 are arranged in the pressure chambers 52-12A, 52-12B, 52-12C, . . . .

Furthermore, similarly to this, in the lowest row in the main scanning direction, nozzles 51 are arranged from the left-hand side, as pressure chambers 51-11A, 51-11B, 51-11C, . . . , and in the row above this in the main scanning direction, the nozzles 51 are arranged in the pressure chambers 51-12A, 51-12B, 51-12C, . . . .

In the present embodiment, a row of nozzles 51 including a plurality of nozzles 51 arrayed in one row in the main scanning direction in this way, for example, the row of nozzles, 51-1A, 51-11B, 51-11C, . . . , and so on, is called a nozzle row.

In the example shown in FIG. 7, twenty of such nozzle rows each comprising a plurality of nozzles 51 arrayed in the main scanning direction are arranged in the sub-scanning direction, and the twenty nozzle rows arranged in the sub-scanning direction are divided into sets of four nozzle rows which are arranged adjacently in the sub-scanning direction. These four nozzle rows arranged adjacently in the sub-scanning direction (for example, the four nozzle rows respectively having nozzles 51-11A, 51-12A, 51-13A and 51-14A as the nozzles 51 as the furthest left-hand end thereof), are taken to be one nozzle block. Therefore, in the example shown in FIG. 7, all of the nozzles depicted in the diagram are divided into five nozzle blocks.

The nozzle block including four nozzle rows arranged consecutively and adjacently in the sub-scanning direction, in an oblique upward direction from the lowermost row, namely, the nozzle rows (51-11A, 51-11B, 51-11C, . . . ), (51-12A, 51-12B, 51-12C, . . . ), (51-13A, 51-13B, 51-13C, . . . ), and (51-14A, 51-14B, 51-14C, . . . ), are taken to be nozzle block 1. The nozzle block including the four nozzle rows arranged adjacently in the sub-scanning direction, obliquely above nozzle block 1, is taken to be nozzle block 2. In the following description, the print head 50 is taken to be constituted by five nozzle blocks each having four nozzle rows.

As shown in FIG. 7, the respective nozzle rows in nozzle block 1 are arranged obliquely and adjacently in the sub-scanning direction, being separated from each other respectively by an interval of Lm in the main scanning direction, as indicated by the nozzles 51-11A, 51-12A, 51-13A and 51-14A at the left-hand end of the nozzle rows, which represent the positions of the nozzle rows. The same applies to the other nozzle block 2, and the like. Furthermore, nozzle block 1 and nozzle block 2 are disposed in such a manner that they are separated by a distance of Pm in the main scanning direction and a distance of Ls in the sub-scanning direction, as indicated by the corresponding nozzles 51-11A and 51-21A.

The distance in the main scanning direction, Pm, is the minimum distance between nozzles in the main scanning direction of the nozzle arrangement in the print head 50 according to the present embodiment. In the present embodiment, dots which are mutually adjacent in the main scanning direction on the recording paper 16 are ejected by nozzles 51 positioned adjacently in the main scanning direction (for example, nozzles 51-11A and 51-21A), and the minimum distance between nozzles in the main scanning direction, Pm, and the minimum distance between dots, Pd, on the recording paper 16 are the same.

Figure 9A:
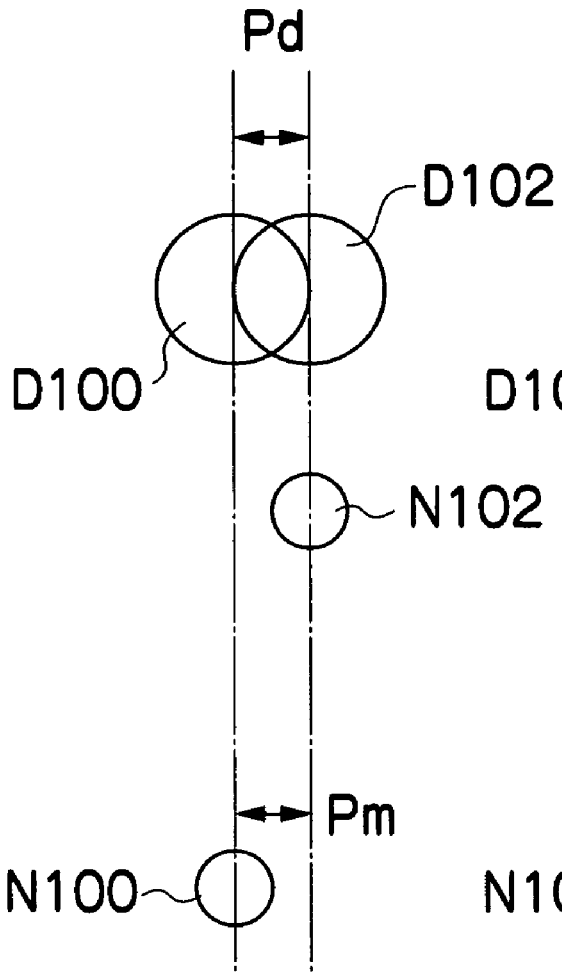
FIGS. 9A and 9B are illustrative diagrams showing the relationship between the nozzle arrangement and the dot positions.
Figure 9B:
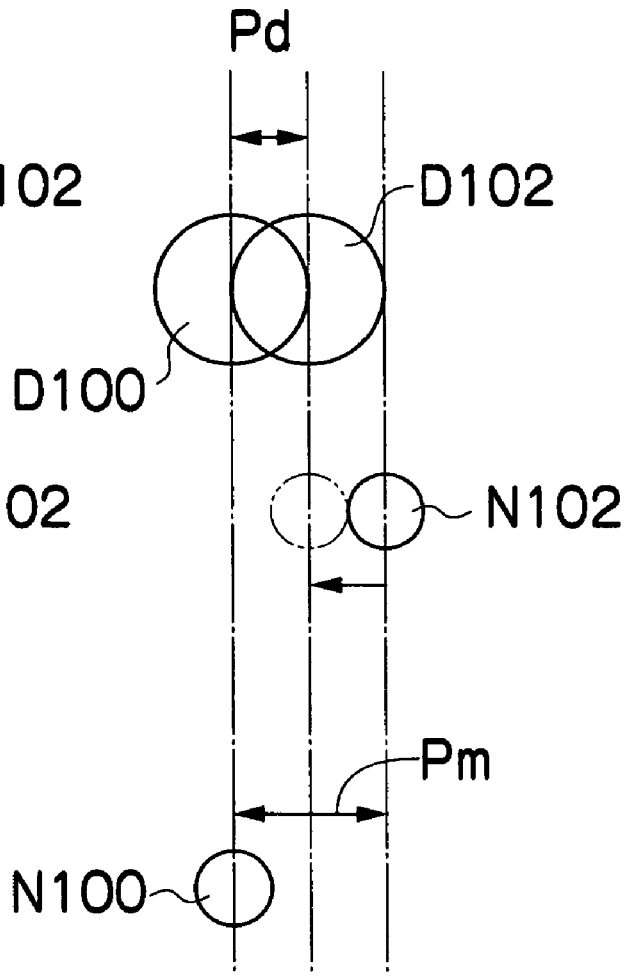

In general, as shown in FIG. 9A, the minimum distance between nozzles, Pm, of the two nozzles N100 and N102 which are adjacent in the main scanning direction, is equal to the minimum distance between dots (dot pitch) Pd between the dots D100 and D102 which are mutually adjacent in the main scanning direction on the recording paper 16. However, the minimum distance between nozzles, Pm, and the minimum distance between dots, Pd, are not always the same. More specifically, as shown in FIG. 9B, it is also possible to construct the print head by reducing the number of nozzles and making the minimum distance in the main scanning direction between nozzles, Pm, of the nozzles N100 and N102 greater than the minimum distance in the main scanning direction between dots, Pd, of the two dots D100 and D102, such that Pm=2×Pd, for instance. During printing, the nozzle position is diverted to the position of the dots that are to be recorded, and droplets are ejected accordingly, by moving the print head intermittently in the main scanning direction, in a staged conveyance action. By adopting a composition of this kind, firstly, the position of the recording paper at which a first dot D100 is to be recorded is conveyed to the position of the nozzle N100, and a droplet is ejected from the nozzle N100, thereby forming a first dot D100. Thereupon, when the position on the recording paper where a second dot D102 is to be recorded is conveyed in the main scanning direction to a position corresponding to the nozzle N102, the print head performs a step movement in the leftward direction in FIG. 9B, through a distance of Pd, and a droplet is ejected from the second nozzle N102 to form a second dot D102. In this way, it is possible to form overlapping dots D100 and D102 similar to those in FIG. 9A. In this case, the minimum distance between nozzles, Pm, and the minimum distance between dots, Pd, are not equal.

In order to describe the nozzle arrangement according to the present embodiment in more detail, FIG. 8 shows an enlarged view of the bottom left-hand portion of FIG. 7. In FIG. 8, the size of the respective pressure chambers 52 (52-11A, . . . , and so on) is depicted to the same scale in both the vertical and horizontal directions (the main scanning direction and the sub-scanning direction).

In each nozzle block, the distance between nozzles that are adjacent in the sub-scanning direction, for example, the distance, Ps, in the sub-scanning direction between the nozzle 51-11A and the nozzle 51-12A of nozzle block 1 in FIG. 8, is the minimum distance between nozzles in the sub-scanning direction (namely, the nozzle pitch in the sub-scanning direction). To be precise, the thickness of the partitions between the pressure chambers, and other factors, should be taken into consideration, but here, it is assumed that this distance is equal to the length, L2, of the pressure chamber 52-11A in the sub-scanning direction.

Furthermore, taking the length of the pressure chamber 52-11A in the main scanning direction to be L1, the minimum interval in the main scanning direction between nozzles in the same nozzle row (for example, the distance between nozzle 51-11A and nozzle 51-11B) is approximately L1. As described above, since the pressure chamber 52 is approximately square in shape, it is possible to assume that L1=L2.

The distance in the sub-scanning direction, Ls, between nozzle block 1 and nozzle block 2 is the product of the minimum distance between nozzles in the sub-scanning direction, Ps, in the nozzle arrangement according to the present embodiment, and the number of nozzle rows constituting each nozzle block, M (where M is a positive integer). In other words, Ls=M×Ps. As shown in FIG. 8, in this example, each nozzle block includes four nozzle rows in the sub-scanning direction (for example, nozzle block 1 includes the four nozzle rows whose left-hand end nozzles 51 are, respectively, nozzle 51-11A, 51-12A, 51-13A and 51-14A). Therefore, M=4 and Ls=4×Ps.

Figure 19:
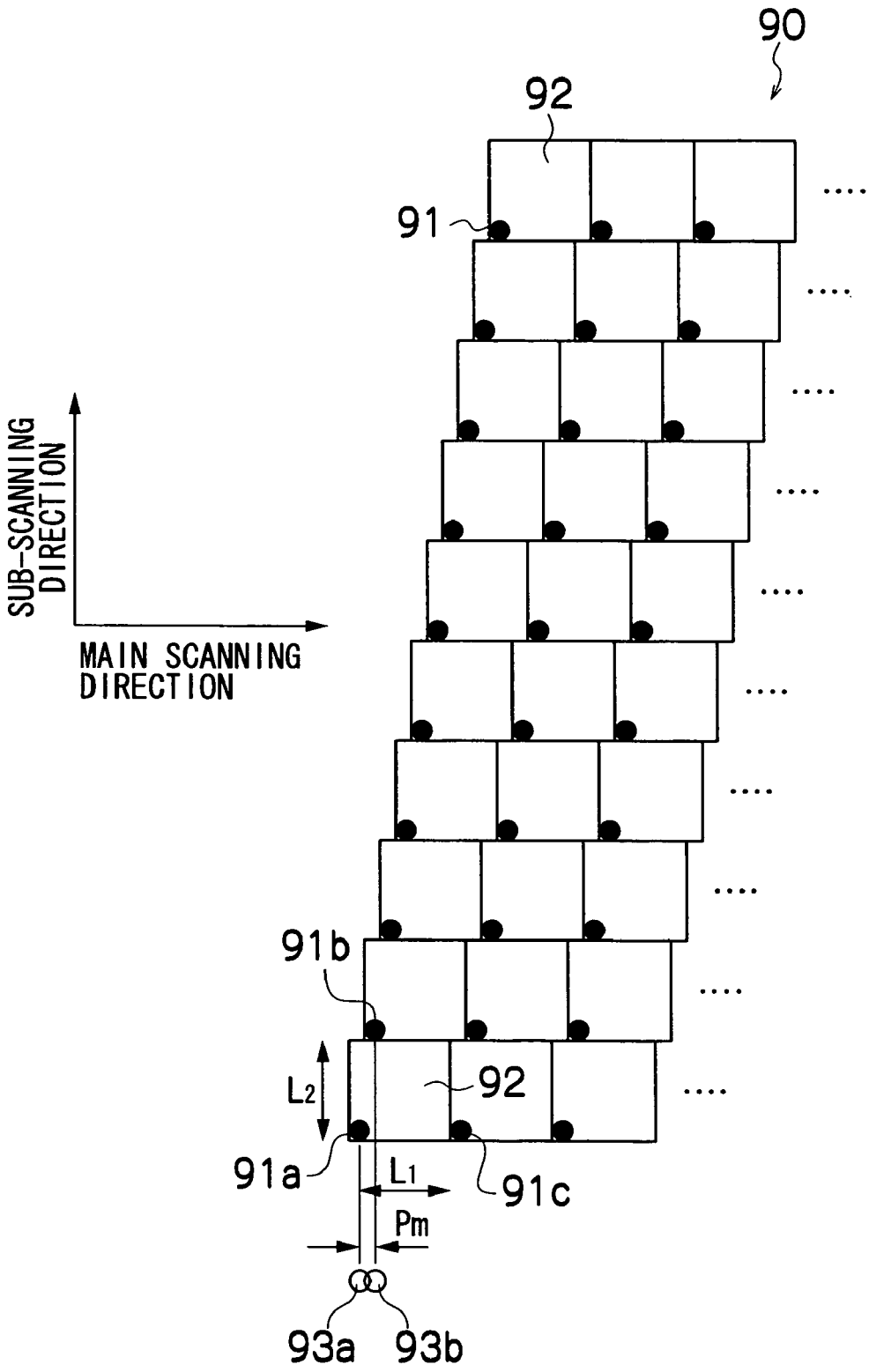
FIG. 19 is a principal plan diagram showing nozzles arranged in a conventional matrix array.

The distance in the main scanning direction between nozzle 51-11A in nozzle block 1 and the nozzle 51-21A in nozzle block 2 is the minimum distance between nozzles, Pm, for the nozzle arrangement according to the present example, and a dot on the recording paper 16 that is ejected by the nozzle 51-11A will overlap with a dot ejected by nozzle 51-21A after conveying the recording paper 16 through a distance of Ls, which is the distance between nozzle blocks in the sub-scanning direction. Therefore, the distance between nozzle 51-11A and nozzle 51-21A which eject droplets to form dots on the recording paper 16 that are mutually adjacent and overlapping in the main scanning direction, is four times the corresponding distance in the conventional nozzle arrangement illustrated in FIG. 19. Therefore, provided that the conveyance velocity of the recording paper 16 is the same as that in the related art, the time interval between the landing times of droplets which are adjacent in the main scanning direction on the recording paper 16 will be four times the corresponding time interval in the case of the related art where nozzles are simply arranged in an oblique fashion, as illustrated in FIG. 19. Therefore, even if the droplets are ejected so as to overlap, landing interference does not occur between the droplets.

Furthermore, the distance Lm in the main scanning direction between nozzles of the same nozzle block which are mutually adjacent in the sub-scanning direction is designed so as to be a multiple by an integer N of the minimum distance between nozzles, Pm, in the main scanning direction according to the present nozzle arrangement. In other words, Lm=N×Pm. More specifically, in the present embodiment, as shown in FIG. 7, the four dots that are adjacent in the main scanning direction to the dot ejected onto the recording paper 16 by nozzle 51-11A, are respectively ejected by the nozzles 51-21A, 51-31A, 51-41A and 51-51A. Therefore, the nozzle 51-11A and the nozzle 51-12A, which are mutually adjacent in the sub-scanning direction in nozzle block 1, are separated in the main scanning direction by a distance corresponding to five nozzles belonging respectively to five different nozzle blocks. Therefore, N is equal to the number of nozzle blocks. In the example shown in FIG. 7, N=5 and Lm=5×Pm. Therefore, the relationship Dmax≦Lm is established with respect to the maximum dot size, Dmax. This applies similarly to the other nozzles in nozzle block 1, and to the other nozzle blocks.

In the present embodiment, landing interference is prevented by disposing the nozzles in this fashion, and if the general conveyance velocity of the recording medium is taken to be V(μm/μsec), and the length of the pressure chamber 52 in the sub-scanning direction is taken to be L2 (μm) (where L2≈Ps), then the time difference between the landing times of the liquid droplets discharged onto the recording paper at the same position in the sub-scanning direction, by nozzles positioned M nozzles apart in the sub-scanning direction, will be Δt=(M×L2)/V(μsec). Therefore, taking the time until the discharged dots become fixed in the recording medium to be t0 (μsec), provided that Δt>t0, these two dots will become fixed without interference occurring between them.

In the case of a simple matrix arrangement as in the related art illustrated in FIG. 19, M=1, but landing interference is prevented by setting the value of M so as to satisfy the relationship Δt>t0. As described above, in the present embodiment, this relationship is satisfied by taking M to be M=4, and increasing the difference between the landing times of adjacent droplets by four times in comparison to the related art.

Furthermore, the nozzle density in the sub-scanning direction (the minimum distance between nozzles, Ps, in the sub-scanning direction according to the present nozzle arrangement) is equal to the interval in the main scanning direction between nozzles that are situated in the same position in the sub-scanning direction (for example, nozzle 51-11A and nozzle 51-11B in FIG. 8). In other words, in FIG. 8, the size of the pressure chamber 52 is taken to be the same in the main scanning direction (horizontal direction) and the sub-scanning direction (vertical direction). In other words, L1=L2. By setting L1=L2 (or L1≈L2), it is possible to ensure the amount of displacement of the actuator and to prevent air bubbles from becoming trapped inside the pressure chamber.

For example, here, L1=L2=200 (μm). Moreover, in the case of FIG. 8, in which twenty nozzles (nozzle rows) are arranged in the sub-scanning direction, if the time interval is calculated between the landing times of adjacent droplets in the main scanning direction discharged onto the recording medium from nozzles which are adjacent in the main scanning direction, taking the nozzle density in the main scanning direction to be 2400 (dpi), and the discharge frequency to be 10 (kHz), in other words, the conveyance velocity of the recording paper to be 100 (mm/sec), then whereas a time interval of 0.2116 (mm)/100 (mm/sec)=2.116 (msec) is obtained when the nozzles are simply arranged in an oblique fashion as in the related art, a time interval of 0.2116×4 (mm)/100 (mm/sec)=8.464 (msec) is obtained in the case of the arrangement according to the present embodiment, as illustrated in FIG. 7 or FIG. 8.

Figure 10:
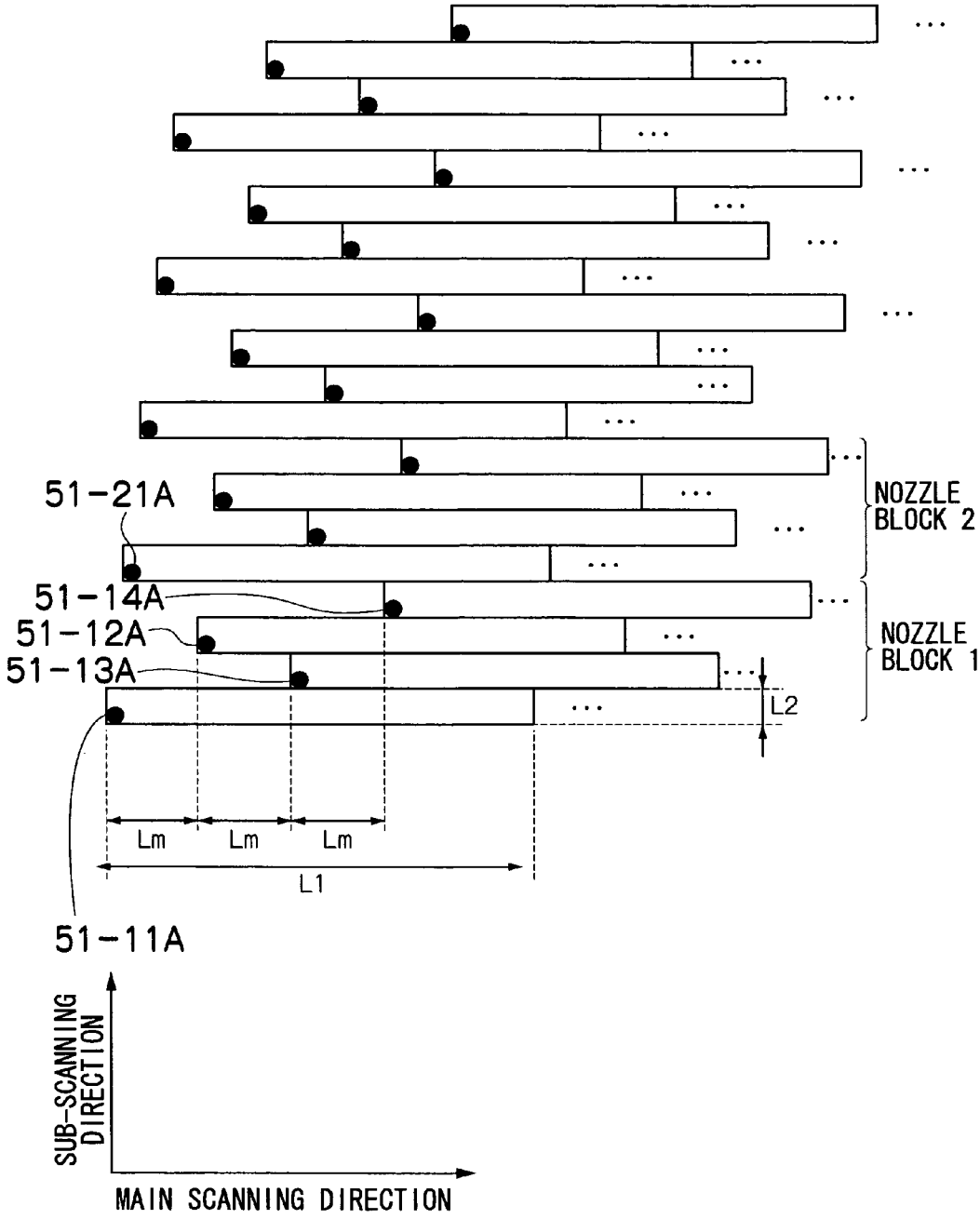
FIG. 10 is a principal plan diagram showing a further nozzle arrangement in a print head according to the present embodiment.

Moreover, FIG. 10 shows a further example of a nozzle arrangement in a liquid droplet discharge head (print head) according to the present embodiment. Similarly to FIG. 7, FIG. 10 also shows the dimension of the pressure chamber in the sub-scanning direction at a reduced scale of 1/20, with respect to the main scanning direction. As shown in FIG. 10, this nozzle arrangement switches the second and third nozzles rows of each block in the sub-scanning direction, in comparison with the nozzle arrangement illustrated in FIG. 7. For example, in nozzle block 1 in FIG. 10, the positions of the nozzle row including nozzle 51-12A and the nozzle row including nozzle 51-13A are switched, in comparison to the nozzle block 1 shown in FIG. 7. The arrangement of the nozzle rows is similarly switched in the other nozzle blocks, too.

This switching of the nozzle rows is only implemented within each respective nozzle block; the relationship between nozzle blocks is exactly the same as that depicted in FIG. 7. For example, the relationship between the nozzle 51-11A of nozzle block 1 and the corresponding nozzle 51-21A of nozzle block 2 (namely, the distance between these nozzles in the main scanning direction and the sub-scanning direction) is exactly the same as that depicted in FIG. 7 and FIG. 8.

Moreover, within each nozzle block, the nozzle adjacent to another nozzle in the main scanning direction is the nozzle of that same nozzle block which has the smallest distance in the main scanning direction from that nozzle. For example, in FIG. 10, the nozzle having the smallest distance in the main scanning direction from the nozzle 51-11A in nozzle block 1 is nozzle 51-12A, and therefore the nozzle adjacent to nozzle 51-11A in nozzle block 1 is nozzle 51-12A, rather than nozzle 51-13A.

Similarly, in nozzle block 1, nozzle 51-13A is the adjacent nozzle to nozzle 51-12A in the main scanning direction, and nozzle 51-14A is the adjacent nozzle to nozzle 51-13A in the main scanning direction. As shown in FIG. 10, the distance in the main scanning direction between nozzles that are adjacent in the main scanning direction is Lm, similarly to the case shown in FIG. 7.

This distance, Lm, between nozzles that are adjacent in the main scanning direction within the same nozzle block is set to be a multiple by an integer N of the minimum distance between nozzles, Pm, in the main scanning direction according to the present nozzle arrangement. In other words, Lm=N×Pm. In FIG. 10, similarly to FIG. 7, five nozzle blocks are formed, and hence N=5 and Lm=5×Pm.

In the example illustrated in FIG. 7, a plurality of nozzle rows constituting respective nozzle blocks are arranged adjacently in the sub-scanning direction, each being separated from the next by a prescribed distance Lm in the main scanning direction. However, in the example shown in FIG. 10, the plurality of nozzle rows constituting each nozzle block are arranged so that they are adjacent to each other at a prescribed distance Lm in the main scanning direction, regardless of whether the plurality of nozzle rows constituting the nozzle block are adjacent in the sub-scanning direction. In this way, in FIG. 10, the nozzle blocks are composed in such a manner that, rather than the nozzle rows in each nozzle block being arranged in a step-like fashion as shown in FIG. 7, they are arranged at alternately displaced positions in the main scanning direction according to their position in the sub-scanning direction.

Figure 11:
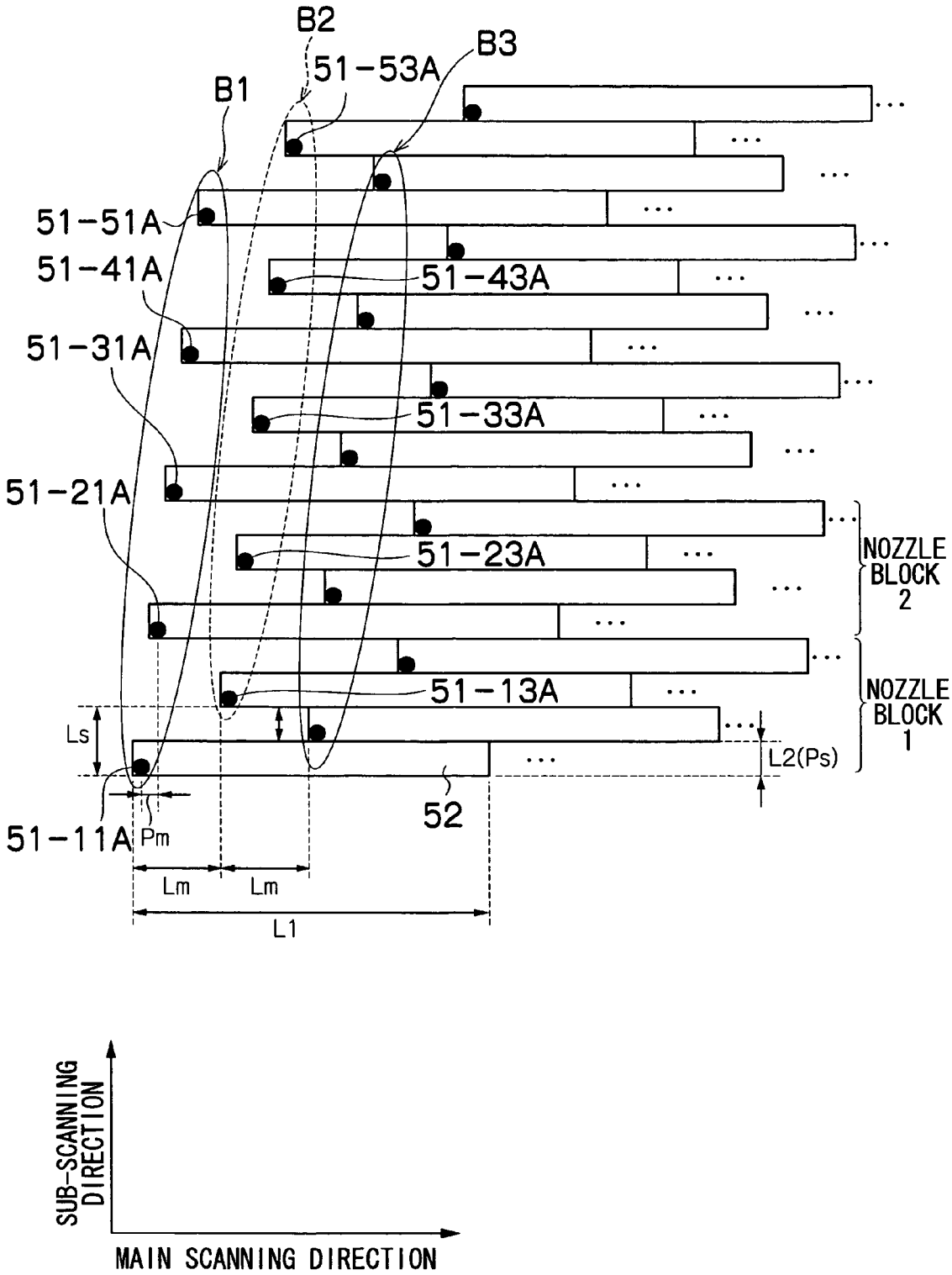
FIG. 11 is a plan diagram showing a further method of dividing nozzle blocks in the nozzle arrangement illustrated in FIG. 10.

The nozzle arrangement shown in FIG. 10 may also be regarded in a different manner. More specifically, the nozzle arrangement shown in FIG. 11 is the same as the nozzle arrangement shown in FIG. 10, but rather than dividing the nozzles into nozzle blocks each formed by four nozzle rows, as in FIG. 10, a set of nozzles is formed by the nozzles 51-11A, 51-21A, 51-31A, 51-41A and 51-51A situated on the furthest left-hand side in the main scanning direction, this set being called a "nozzle group" to distinguish it from the nozzle blocks in FIG. 10. The nozzle group constituted by nozzles 51-11A, 51-21A, 51-31A, 51-41A and 51-51A is taken to be nozzle group B1, for example, and the group constituted by the five nozzles 51-13A, 51-23A, 51-33A, 51-43A and 51-53A, is taken to be nozzle group B2. Further nozzle groups, from nozzle group B3 onwards, are constituted in a similar manner.

The nozzle groups B1, B2, . . . , each including five nozzles, are located in alternately staggered positions in the sub-scanning direction, as shown in FIG. 11.

More specifically, as described thus far, the distance, Lm, between nozzle groups in the main scanning direction is taken to be Lm=N×Pm, namely, a multiple by an integer N (where N is the number of nozzles in each group; in this case, 5) of the minimum distance between nozzles, Pm, in the main scanning direction according to this arrangement.

Furthermore, as regards the distance, Ls, between nozzle groups in the sub-scanning direction, in the case of nozzle group B1 and nozzle group B2, for example, by comparing nozzle 51-11A and nozzle 51-13A, it is seen that Ls is twice the minimum distance between nozzles in the sub-scanning direction, Ps (which is approximately equal to the size of the pressure chamber 52 in the sub-scanning direction, L2). In other words, Ls=2×Ps (=2×L2).

Moreover, the interval, Ls, between the nozzle group B2 and the next nozzle group B3 in the sub-scanning direction is exactly equal to the minimum interval between nozzles, Ps, in the sub-scanning direction. This is repeated in subsequent nozzle groups.

Furthermore, the nozzle arrangement is designed in such a manner that nozzles which are mutually adjacent or disposed near to each other in the sub-scanning direction, such as nozzles 51-11A and 51-12A in FIG. 7 are separated by a distance in the main scanning direction that is greater than the diameter of the liquid droplets discharged from the nozzles.

Here, it is supposed that the diameter of the nozzles is 30 (μm) and that the diameter of the liquid droplets is approximately the same as the nozzle diameter. More specifically, taking the maximum dot size of the droplets ejected from the nozzles onto the recording medium to be Dmax, then the divergence in the main scanning direction between each nozzle block is set to a positive factor N of the minimum distance between nozzles, Pm, in the main scanning direction, namely, N×Pm, in such a manner that Dmax≦N×Pm.

By separating the nozzles by a distance of N×Pm in the main scanning direction in this way, it is possible to prevent image degradation, by avoiding overlap in a durable fashion, not only immediately after the discharge of the liquid droplets from the nozzles, but also during subsequent conveyance of the recording medium. As described above, the factor N is set to be the number N of nozzle blocks.

Furthermore, in FIG. 7, when setting the interval Ls between nozzle blocks in the sub-scanning direction, an interval that is a multiple by an integer of the minimum distance between nozzles, Ps, in the sub-scanning direction is used. More specifically, the integer M is the number of nozzle rows M arranged in the sub-scanning direction in each nozzle block.

However, it is also possible to use the following approach to set the interval, Ls, between adjacent nozzle blocks in the sub-scanning direction. More specifically, when a droplet has been ejected from nozzle 51-11A in nozzle block 1 in FIG. 7 and a portion of that droplet has permeated into the recording paper 16, thereby reducing the diameter of the droplet on the surface of the recording paper 16, then it is possible to convey the recording paper 16 and discharge a droplet from the nozzle 51-21A of the nozzle block 2 so as to overlap with the aforementioned droplet. As described in more detail below, even if a droplet is discharged so as to overlap with the region in which another droplet has previously permeated into the recording paper 16, then since the permeated droplet has become fixed, no mixing or bleeding of the subsequently discharge droplet will occur on the surface of the recording paper 16.

In other words, landing interference will not occur, provided that the sum of the radius of the droplet remaining on the surface of the recording paper 16 when a portion (the perimeter edge) of a previously ejected droplet has permeated into the recording paper 16, and the radius of a subsequently ejected droplet on the surface of the recording paper 16, is less than then dot pitch (the minimum distance between nozzles, Pm, in the main scanning direction). Therefore, the interval, Ls, between nozzle blocks in the sub-scanning direction is set to the distance through which the recording paper 16 is conveyed in the time period from the ejection of a previously ejected droplet until the time at which the radius of that droplet on the surface of the recording paper 16 reaches a size that satisfies the foregoing condition. The nozzle blocks are disposed in such a manner that they are separated by this distance, Ls, in the sub-scanning direction.

The droplet ejection interval required in order that there is no landing interference between the liquid dots ejected adjacently in an overlapping fashion in the main scanning direction is described below.

Figure 12:
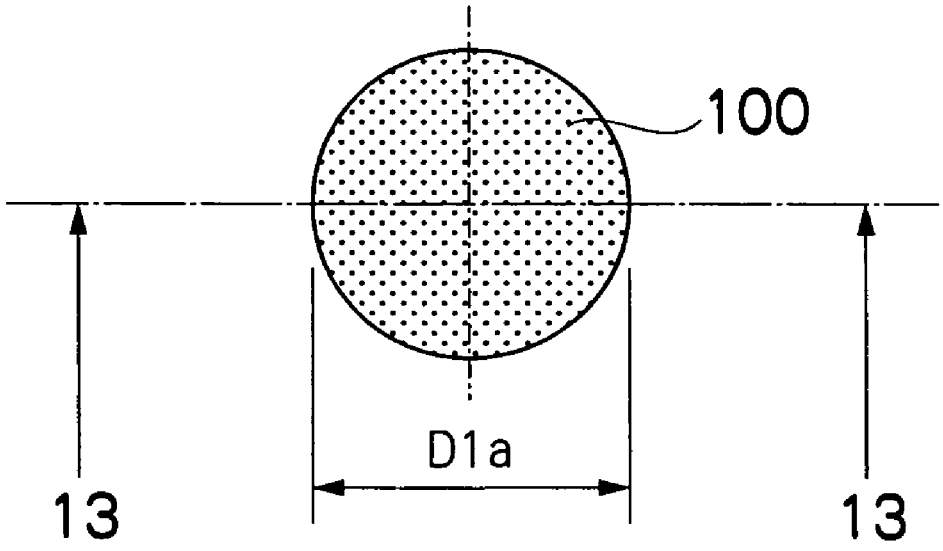
FIG. 12 is an illustrative diagram of droplet ejection control in an inkjet recording apparatus according to the present embodiment.

This description relates to an example where the nozzles ejecting droplets to form adjacent dots in the main scanning direction are nozzle 51-11A of nozzle block 1 and nozzle 51-21A in nozzle block 2, illustrated in FIG. 7 or FIG. 8. FIG. 12 shows an ink droplet 100 ejected previously by the nozzle 51-11A. The diameter of the ink droplet 100 on the surface of the recording paper 16 is D1*a*.

If a dye based ink is used, then when the ink droplet 100 lands on the surface of the recording paper 16, it permeates into the image receiving layer of the recording paper 16 (not illustrated) over time, and since this permeation is completed from the outer side toward the inner side of the ink droplet 100, the diameter of the ink droplet gradually decreases toward the center.

When a prescribed time period T has passed, the solvent on the surface of the recording paper 16 has disappeared and the ink droplet 100 has permeated completed into the recording paper 16. Here, a dot of a prescribed size is formed. (In the present embodiment, the dot has the same diameter as the diameter of the ink droplet when it lands on the paper). This time period T is taken to be the complete permeation time.

Figure 13:
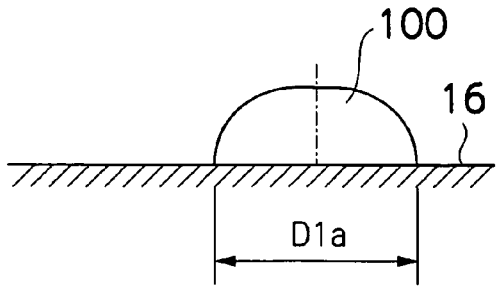
FIG. 13 is a cross-sectional view along line 13-13 in FIG. 12.
Figure 14:
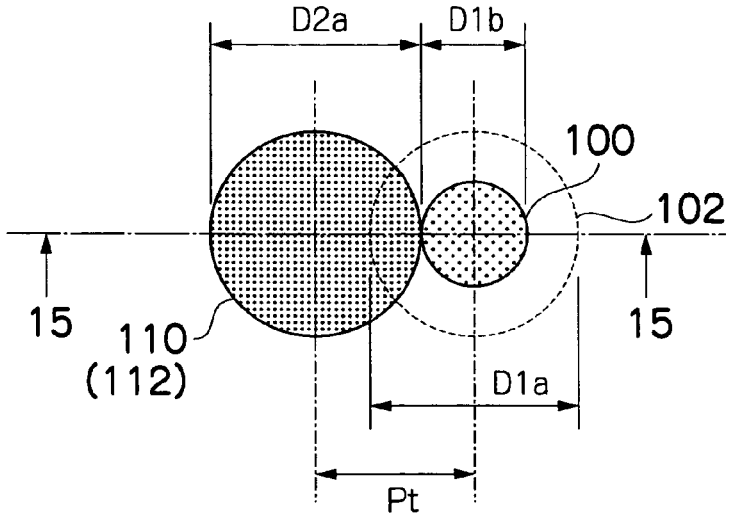
FIG. 14 is a plan diagram for illustrating the principal part of droplet ejection control.

FIG. 13 is a cross-sectional diagram along line 13-13 in FIG. 12, and it shows a state immediately after the ink droplet 100 has landed on the recording paper 16. FIG. 14 shows a state where a prescribed time period, which is less than the complete permeation time T, has elapsed since the ink droplet 100 landed on the recording paper 16. In this state, the diameter of the ink droplet 100 on the surface of the recording paper 16 has become D1*b*.

The circle indicated by the dotted line in FIG. 14 shows the dot 102 that is formed by the ink droplet 100, and its size is approximately the same as that of the ink droplet 100 upon landing on the recording paper 16. More specifically, a dot 102 having a diameter of D1*a* is formed by the ink droplet 100.

Furthermore, FIG. 14 shows a state where an ink droplet 110 having a diameter of D2*a* is subsequently ejected by nozzle 51-21A of nozzle block 2. The distance in the main scanning direction between the nozzle 51-11A that ejected the previous ink droplet 100 and the nozzle 51-21A is the minimum distance between nozzles, Pm, in the main scanning direction according to the present nozzle arrangement.

The interval between the center of the ink droplet 110 and the center of the dot 102 (namely, the dot pitch) Pt, is equal to this minimum distance between nozzles, Pm, in the main scanning direction.

If the relationship between the diameter D1*b* of the ink droplet 100 previously ejected by nozzle 51-11A after a time period δT has elapsed since its landing on the recording paper 16, the diameter D2*a* of the ink droplet 110 upon landing on the recording paper 16, and the interval Pt between the ink droplet 100 and the ink droplet 110 (which corresponds to the pitch between the dots formed by the ink droplet 100 and the ink droplet 110), satisfies the following relationship (1):

$$Pt>(D1b/2)+(D2a/2), \quad (1)$$

then the sum of the radii of the ink droplets 100 and 110 (which have respective values of (D1*b*/2) and (D2*a*/2)) will be smaller that the dot pitch, Pt, and therefore the ink droplet 100 and the ink droplet 110 will not combine on the surface of the recording paper 16. Consequently, the shapes of the dot 102 and the dot 112 formed by the ink droplet 100 and the ink droplet 110 are not disrupted (in FIG. 14, dot 112 is formed at the same position and to the same size as the ink droplet 110). Therefore, the desired dot shape can be achieved.

The relationship (1) described above may be rewritten as the following relationship (2):

$$D1b<2\times Pt-D2a. \quad (2)$$

In other words, the time period until the diameter D1*a* of the ink droplet 100 discharged from nozzle 51-11 onto the recording paper 16 reaches a diameter D1*b* satisfying the relationship (2) can be taken as a droplet ejection interval which prevents the occurrence of landing interference.

Here, the condition for overlapping between dot 102 and dot 112 is the inverse of the relationship (1), namely, Pt<(D1*b*/2)+(D2*a*/2). In other words, the condition for overlapping between the dots 102 and 112 is that the sum of the radius of the dot 102 plus the radius of the dot 112 be greater than the dot pitch Pt.

The dot 102 shown in FIG. 14 comprises a region where the ink droplet 100 has not permeated into the recording paper 16 (the region illustrated as an ink droplet 100), and a region where the ink droplet 100 has permeated completely into the recording paper 16 and the coloring material of the ink (in solution) is held within the image receiving layer of the recording paper 16 (the region of the dot 102 indicated by the dotted line, minus the region indicated by the ink droplet 100). Out of these two regions, it is possible to eject another ink droplet 110 so as to land on the region where the ink droplet 100 has permeated completely into the recording paper 16.

Figure 15:
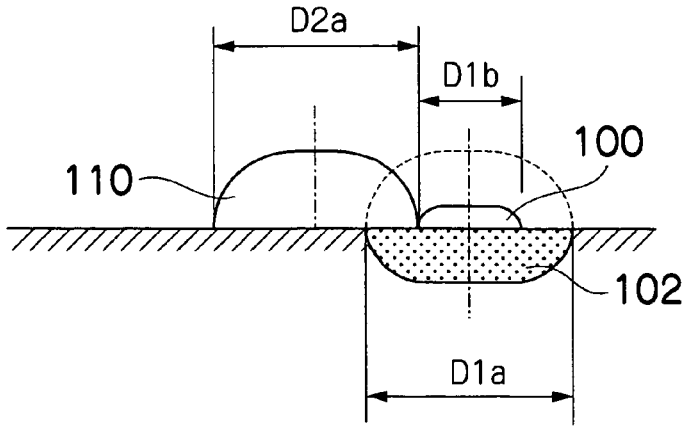
FIG. 15 is a cross-sectional view along line 15-15 in FIG. 14.

FIG. 15 is a cross-sectional diagram showing a cross-section of ink droplet 100 and ink droplet 110 viewed along line 15-15 in FIG. 14. As the ink droplet 110 permeates into the recording paper 16, the ink droplet 100 and the ink droplet 110 may combine in the image receiving layer of the recording paper 16 in the region of overlap between the dot 102 and the ink droplet 110. However, even if such combination occurs, since the ink droplet 100 has already permeated into the image receiving layer and the coloring material (in solution) has been retained in this layer, there will be virtually no change in the shape of the dot 102 within the image receiving layer.

Figure 16:
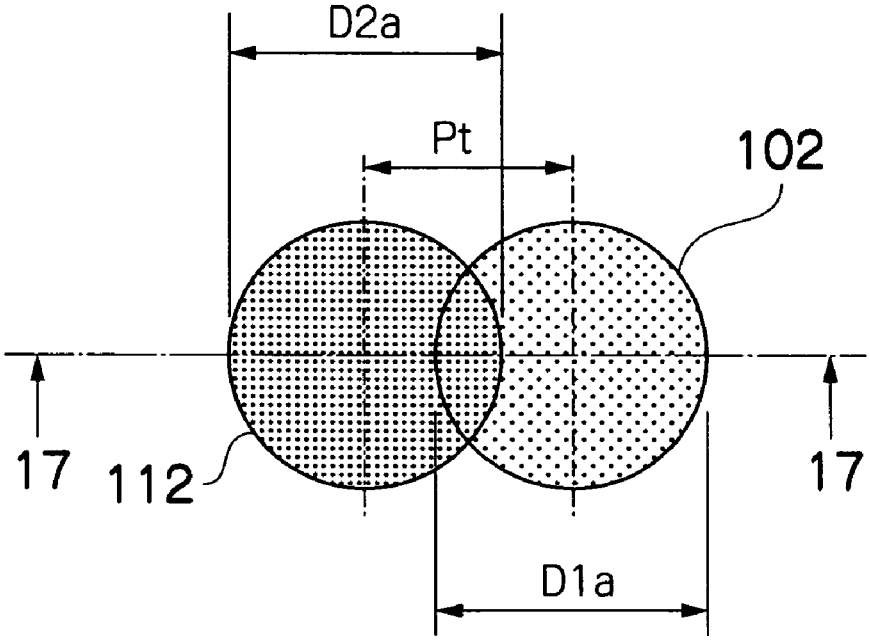
FIG. 16 is a plan diagram for illustrating the results of droplet ejection control.

When the aforementioned complete permeation time T has elapsed since the ink droplet 110 landed on the recording paper 16, the ink droplet 110 will have permeated completely into the recording paper 16, and the dot 102 of diameter D1*a* and the dot 112 of diameter D2*a* will have been formed, as shown in FIG. 16.

Figure 17:
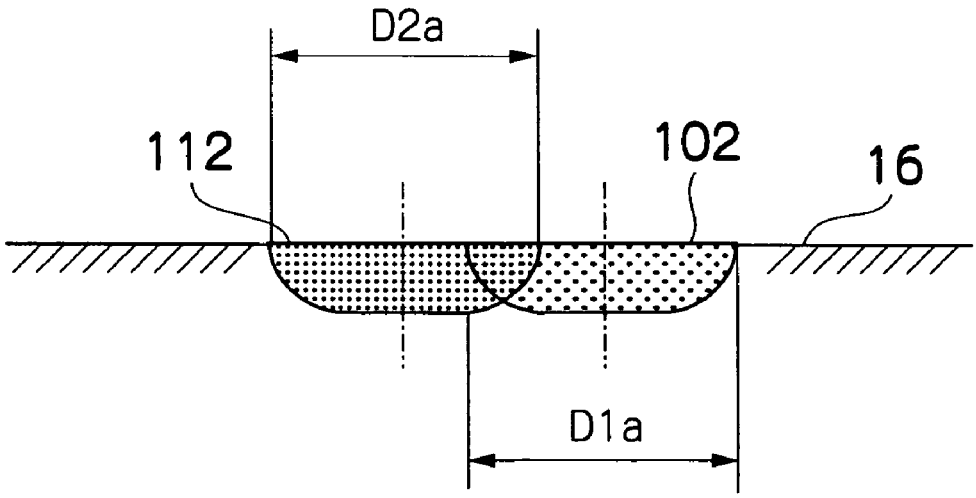
FIG. 17 is a cross-sectional view along line 17-17 in FIG. 16.

FIG. 17 is a cross-sectional diagram showing a cross-section of the dot 102 and the dot 112 viewed along line 17-17 in FIG. 16.

In this way, when two dots are to overlap, after ejecting a first ink droplet, it is possible to eject the succeeding ink droplet without having the wait for the complete permeation time T, which is the time period until the previously ejected ink droplet has permeated completely into the paper. Namely, the succeeding ink droplet can be ejected while D1*b* is still greater than 0.

In other words, the value of the diameter D1*b* of the ink droplet 100 that will satisfy the relationship (1) described above when the ink droplet 110 lands on the paper, is determined from the interval Pt between the preceding ink droplet 100 and the succeeding ink droplet 110 and the diameter D2*a* of the ink droplet 110 upon landing. The diameter D1*b* of the ink droplet 100 thus determined, and the diameter D1*a* of the ink droplet 100 upon landing on the paper, are used to calculate the permeation time δT. The droplet ejection timings of the ink droplet 100 discharged from the nozzle 51-11A and the ink droplet 110 discharged from the nozzle 51-21A are controlled by using the permeation time δT thus determined as the droplet ejection interval.

Furthermore, the product of the time thus determined δT, and the conveyance velocity, V, of the recording paper 16, namely, δT×V, should be taken as the prescribed interval in the sub-scanning direction, and the nozzle block 1 and the nozzle block 2 should be positioned in such a manner that nozzle 51-11A and nozzle 51-21A are separated by this prescribed distance in the sub-scanning direction.

Figure 18:
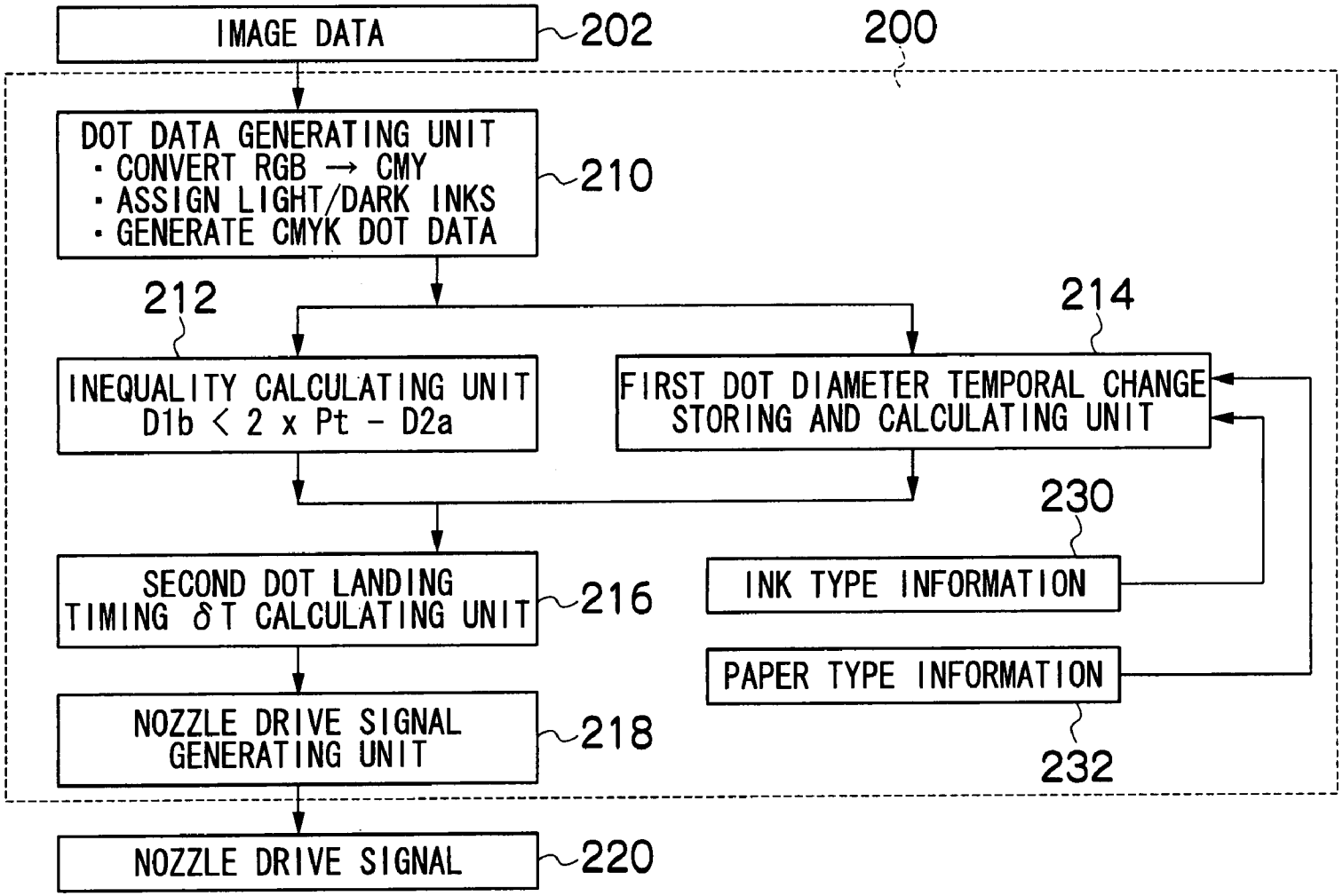
FIG. 18 is a block diagram of a droplet ejection control section in an inkjet recording apparatus according to the present embodiment.

FIG. 18 is a block diagram showing a system (droplet ejection control unit) which implements droplet ejection control of this kind. The droplet ejection control unit 200 is contained in the system (print controller 80) shown in FIG. 6.

When image data 202 is obtained from the host computer 86 shown in FIG. 6, a dot data generating unit 210 performs processing for converting the RGB data into CMY data, allocating use of the dark and light inks, and generating CMYK dot data.

Thereupon, an inequality calculating unit 212 determines the diameter D1*b* of the preceding ink droplet (ink droplet 100 in FIG. 16), from the pitch Pt between the two dots (for example, the pitch between the ink droplet 100 and the ink droplet 110 shown in FIG. 16), and the diameter D2*a* of the succeeding ink droplet (the ink droplet 110 in FIG. 16). Information relating to temporal change in the size of the ink droplets is stored in a dot size calculating and storing unit 214. By referring to this information, a timing calculation unit 216 determines the permeation time δT until the aforementioned value of D1*b* is reached, from the diameter D1*a* of the preceding ink droplet forming a dot, at the time that it lands on the paper. (In other words, it determines the droplet ejection interval). Furthermore, the timing control parameters in the sub-scanning direction (such as the conveyance velocity of the recording paper), and the timing control parameters in the main scanning direction are determined from this permeation time period δT.

A drive signal 220 for the respective nozzles 51-11A and 51-21A is generated by a nozzle drive signal generating unit 218, on the basis of the permeation time δT, and the timing control parameters relating to the sub-scanning direction and the main scanning direction determined in this manner.

Here, the speed at which the ink droplet permeates into the recording paper 16 is determined principally by the type of ink, the type of recording paper 16, the ambient temperature, the humidity, and the like. The dot size calculating and storing unit 214 stores this various information in the form of a data table, and it calculates the parameters used to derive the permeation time δT and supplies these to the timing calculation unit 216.

Values for the diameter D1*b* may also be calculated in advance, from the aforementioned diameter D1*a*, the diameter D2*a* and the dot interval Pt, and registered in a database. The permeation time δT can then be determined by referring to the data for the diameter D1*b* in this database. The database may be provided inside the inkjet recording apparatus 10, or it may be provided externally.

As described above, by positioning nozzles as illustrated in FIG. 7 and FIG. 10, in nozzle blocks which are respectively displaced in the sub-scanning direction by an amount corresponding to the distance through which the recording paper 16 is conveyed during the permeation time δT determined as described above (this distance between calculated by V×δT on the basis of the conveyance velocity V of the recording paper 16), it is possible to increase the time interval between landing times of ink droplets which are discharged from different nozzles and are mutually overlapping on the recording medium. Therefore, bleeding of the ink droplets landing on the recording medium can be prevented.

Above, a mode is described in which dots ejected onto a recording medium become fixed by the permeation of liquid droplets into the surface of the recording medium. However, even in the case of a mode in which dots ejected onto a recording medium become fixed by means of liquid droplets on the surface of the recording medium drying or hardening and thus solidifying on the surface of the medium, it is still possible to control the droplet ejection interval in the same way as a case where the droplets permeate into the recording medium.

Furthermore, by positioning nozzles which are adjacent or mutually proximate in the main scanning direction, at a prescribed distance apart in the sub-scanning direction, this distance allowing a sufficient time period for the liquid dots to become fixed in the recording medium, it is possible reliably to prevent landing interference, and hence high-quality image recording can be achieved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet discharge head, comprising:

a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, comprising:

at least a portion of dots formed by the droplets deposited on the recording medium from the nozzles overlap mutually in the main scanning direction; and a first nozzle and a second nozzle located in adjacent nozzle blocks which discharge droplets to form mutually adjacent dots in the main scanning direction on the recording medium, and a third nozzle which is adjacent to the first nozzle in the sub-scanning direction, wherein the positions of the first nozzle and the second nozzle are separated in the sub-scanning direction by at least a distance equal to a product of a distance between the first nozzle and the third nozzle in the sub-scanning direction and an integer that is at least two, and the positions of the first nozzle and the third nozzle are separated in the main scanning direction by at least a distance of diameter of the discharged liquid droplets.

2. The liquid droplet discharge head as defined in claim 1, wherein the distance between the first nozzle and the third nozzle in the main scanning direction is at least a distance equal to a product of a distance between the first nozzle and the second nozzle in the main scanning direction and an integer that is at least two.

3. An image forming apparatus, comprising the liquid droplet discharge head as defined in claim 1.

4. The liquid discharge head as defined in claim 1, wherein the liquid droplet discharge head is a full-line head covering an entire width of the recording medium.

5. A liquid droplet discharge head, comprising:

a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, in such a manner that:

at least a portion of dots formed by the droplets deposited on the recording medium from the nozzles overlap mutually in the main scanning direction; and a plurality of nozzle blocks are formed by a plurality of nozzle rows aligned along the main scanning direction, the nozzle rows being arranged adjacently in the sub-scanning direction and being displaced with respect to each other in the main scanning direction, in such a manner that there always exists one nozzle row displaced by a prescribed distance in the main scanning direction with respect to any other nozzle row; and when a minimum distance between the nozzles in the main scanning direction in the liquid droplet discharge head is denoted by Pm, the nozzle blocks that are adjacent in the sub-scanning direction are displaced by a prescribed interval in the sub-scanning direction and are also displaced in the main scanning direction by the minimum distance between the nozzles, Pm, in the main scanning direction.

6. The liquid droplet discharge head as defined in claim 5, wherein the prescribed distance by which the nozzle rows are displaced in the main scanning direction is set to be equal to N×Pm, where Pm is the minimum distance between the nozzles in the main scanning direction, and N is a number of nozzle blocks.

7. The liquid droplet discharge head as defined in claim 5, wherein the prescribed interval between the nozzle blocks in the sub-scanning direction is set to be equal to M×Ps, where Ps is a minimum distance between the nozzles in the sub-scanning direction which is a distance between the nozzles that are mutually adjacent in the sub-scanning direction in the nozzle array, and M is a number of the nozzle rows constituting the nozzle block.

8. The liquid droplet discharge head as defined in claim 5, wherein the prescribed interval in the sub-scanning direction between a first nozzle block and a second nozzle block, respectively having first nozzles and second nozzles that discharge droplets to form dots overlapping in the main scanning direction on the recording medium, is set to be at least a distance through which the recording medium is conveyed relatively in a time period from a landing time of a first dot discharged from a first nozzle until a time at which the first dot proceeds to become fixed in the recording medium and a diameter of the liquid droplet of the first dot on the recording medium reduces to such a size that the droplet does not make contact with a droplet on a surface of the recording medium corresponding to a second dot discharged from a second nozzle after landing of the first dot.

9. The liquid droplet discharge head as defined in claim 5, wherein, when a maximum dot diameter of a liquid droplet deposited onto the recording medium by any nozzle constituting the nozzle row is denoted by Dmax, a number of the plurality of nozzle blocks N is set to satisfy $Dmax \leqq N \times Pm$, where Pm is the minimum distance between the nozzles in the main scanning direction.

10. An image forming apparatus, comprising the liquid droplet discharge head as defined in claim 5.

11. The liquid discharge head as defined in claim 5, wherein the liquid droplet discharge head is a full-line head covering an entire width of the recording medium.

12. A liquid droplet discharge head, comprising:

a plurality of nozzles which discharge liquid droplets onto a recording medium, wherein the nozzles are arranged two-dimensionally in a main scanning direction perpendicular to a conveyance direction in which the recording medium is conveyed relatively with respect to the liquid droplet discharge head, and a sub-scanning direction which coincides with the conveyance direction, in such a manner that:

at least a portion of dots formed by the droplets deposited on the recording medium from the nozzles overlap mutually in the main scanning direction;

a distance in the sub-scanning direction between a first nozzle and a second nozzle which discharge droplets to form a first dot and a second dot so as to be mutually adjacent or overlapping in the main scanning direction on the recording medium, is set to be at least a distance through which the recording medium is conveyed in a time period from a landing time of the first dot on the recording medium, until a time at which the droplet of the first dot has been fixed in the recording medium and a diameter of the droplet on a surface of the recording medium has reduced to such a size that the droplet does not make contact with a liquid droplet on the surface of the recording medium corresponding to a second dot deposited after the first dot has landed; and the first nozzle and a third nozzle adjacent to the first nozzle in the sub-scanning direction are positioned in such a manner that a distance in the main scanning direction between the first nozzle and the third nozzle is at least a maximum dot diameter formed by the liquid droplets discharged onto the recording medium from the first nozzle and the third nozzle.

13. An image forming apparatus, comprising the liquid droplet discharge head as defined in claim 12.

14. The liquid discharge head as defined in claim 12, wherein the liquid droplet discharge head is a full-line head covering an entire width of the recording medium.

* * * * *